US012662306B2

(12) United States Patent
Ankeny

(10) Patent No.: US 12,662,306 B2
(45) Date of Patent: Jun. 23, 2026

(54) SHIPPING AND STORAGE CONTAINER FOR PERISHABLE GOODS

(71) Applicant: Nexyst Acquisition, LLC, Eden Prairie, MN (US)

(72) Inventor: Robert Ankeny, Victoria, MN (US)

(73) Assignee: AGX LLC, Eagle, ID (US)

( * ) Notice: Subject to any disclaimer, the term of this patent is extended or adjusted under 35 U.S.C. 154(b) by 0 days.

(21) Appl. No.: 18/400,493

(22) Filed: Dec. 29, 2023

(65) Prior Publication Data

US 2024/0253896 A1 Aug. 1, 2024

Related U.S. Application Data

(60) Provisional application No. 63/436,532, filed on Dec. 31, 2022.

(51) Int. Cl.
*B65D 88/74* (2006.01)

(52) U.S. Cl.
CPC ..... *B65D 88/74* (2013.01)

(58) Field of Classification Search
CPC .... B65D 88/74; B65D 88/542; B65D 88/741; B65D 90/0053; B65D 88/745; B65D 1/323; B65D 1/326; B65D 35/34; B65D 88/121; B65D 88/12; Y10S 220/913
See application file for complete search history.

(56) References Cited

U.S. PATENT DOCUMENTS 3,981,083 A * 9/1976 Danford ..... B65D 88/745 34/225
4,891,954 A 1/1990 Thomsen
4,951,479 A 8/1990 Araquistain et al.
4,966,207 A * 10/1990 Howard ..... B65D 85/84 206/524.5
5,152,155 A 10/1992 Shea et al.
5,356,638 A * 10/1994 Varan ..... A23C 9/1226 426/8
5,415,009 A 5/1995 Weiner et al.
5,460,013 A 10/1995 Thomsen
5,487,485 A * 1/1996 Yang ..... B65D 90/048 220/1.5
5,768,894 A * 6/1998 Li ..... B01D 1/222 165/DIG. 84
5,953,924 A * 9/1999 Li ..... F28F 13/125 202/175
5,979,173 A 11/1999 Tyree
(Continued)

FOREIGN PATENT DOCUMENTS

CA 3024777 10/2014
WO 1995015866 6/1995

*Primary Examiner* — Kareen K Thomas
(74) *Attorney, Agent, or Firm* — Pauly, DeVries Smith & Deffner LLC

(57) ABSTRACT

A shipping and storage container for the shipment of perishable goods, the shipping container comprising: an enclosed area containing a top, a bottom, back wall, side walls, and a front gate; at least to permeable removable ventilation tubes extending into the enclosed area, the ventilation tubes in communication with the exterior of the container, the ventilation tubes secured to flush mounted ports mounted in the back wall of the container, the ports being substantially flush with the interior and exterior of the container.

18 Claims, 26 Drawing Sheets

(56) References Cited

U.S. PATENT DOCUMENTS

| | | | | |
|---|---|---|---|---|
| 6,981,422 | B1 * | 1/2006 | Comardo | G01M 3/3227 73/756 |
| 9,567,157 | B2 | 2/2017 | Scudder et al. | |
| 9,790,079 | B2 * | 10/2017 | Groesbeck | B67D 3/0067 |
| 11,111,188 | B2 * | 9/2021 | Shuttleworth | C05F 17/914 |
| 11,142,394 | B1 | 10/2021 | Delong | |
| 2005/0098473 | A1 * | 5/2005 | Sheehan | H01L 21/67369 206/832 |
| 2012/0021504 | A1 * | 1/2012 | Bradlee | C05F 17/979 435/290.4 |
| 2013/0193164 | A1 * | 8/2013 | Tom | B65D 25/16 222/105 |
| 2017/0108261 | A1 | 4/2017 | Broussard | |
| 2017/0158386 | A1 * | 6/2017 | Ruhmel | B65D 59/02 |
| 2019/0100338 | A1 | 4/2019 | Scudder et al. | |
| 2019/0161277 | A1 | 5/2019 | Pap | |
| 2019/0193931 | A1 * | 6/2019 | Kendall | B65D 88/522 |
| 2019/0300410 | A1 * | 10/2019 | Katz | B01D 61/025 |
| 2021/0309451 | A1 | 10/2021 | Kiil et al. | |
| 2022/0401376 | A1 * | 12/2022 | Drzewinski | A61K 9/0024 |

* cited by examiner

DETAIL B

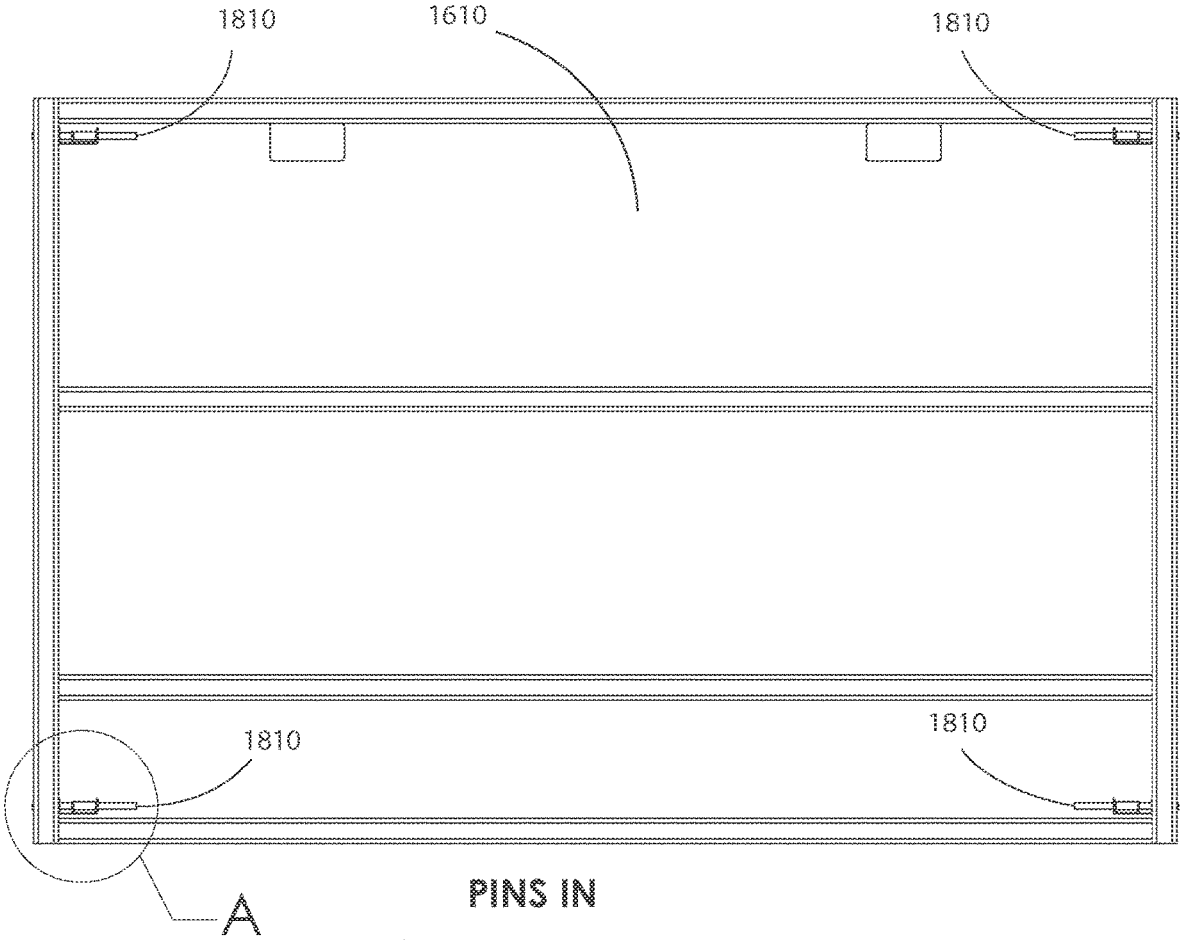
PINS IN
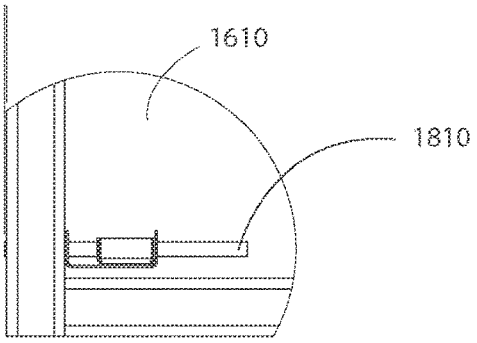
DETAIL A
FIG. 18

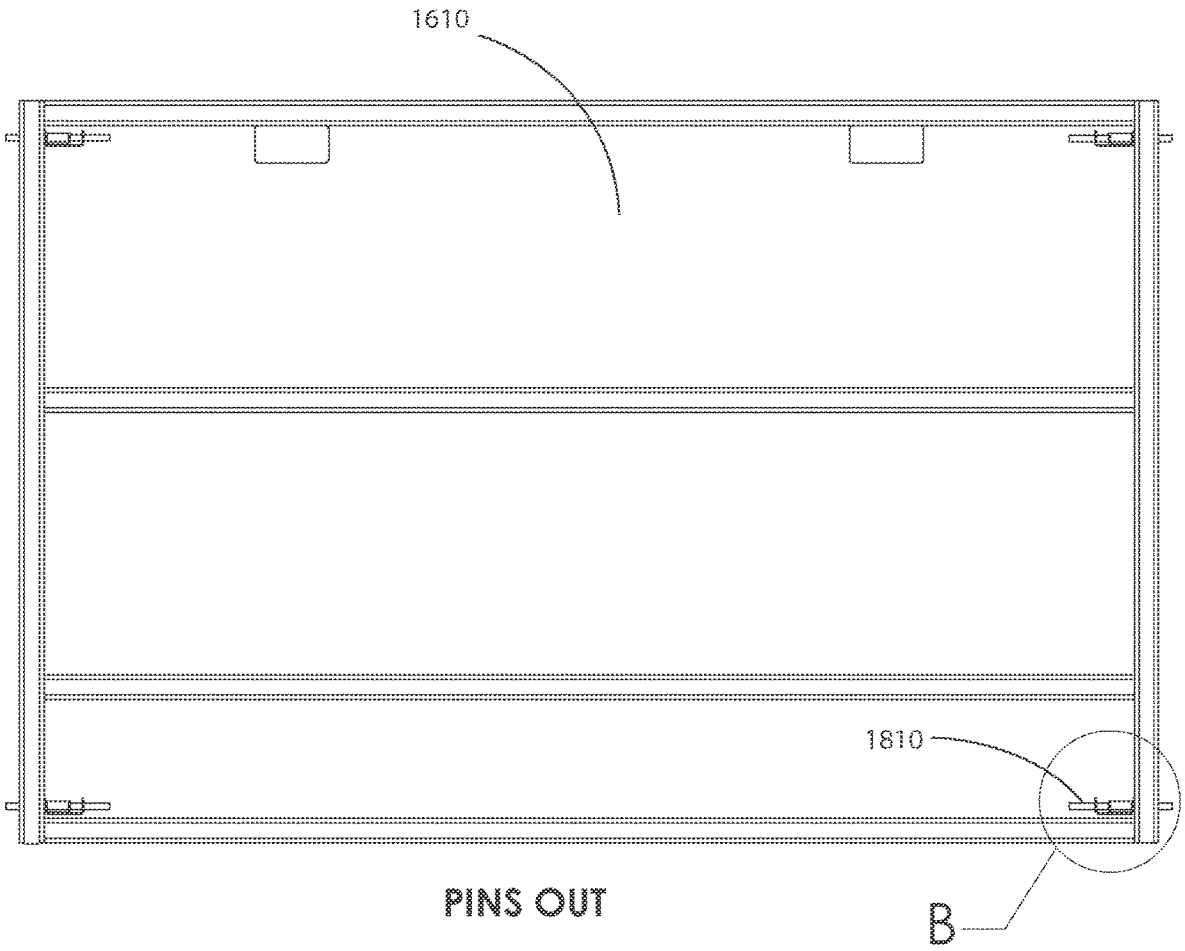
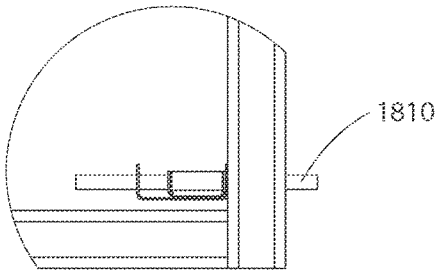
DETAIL B
FIG. 19

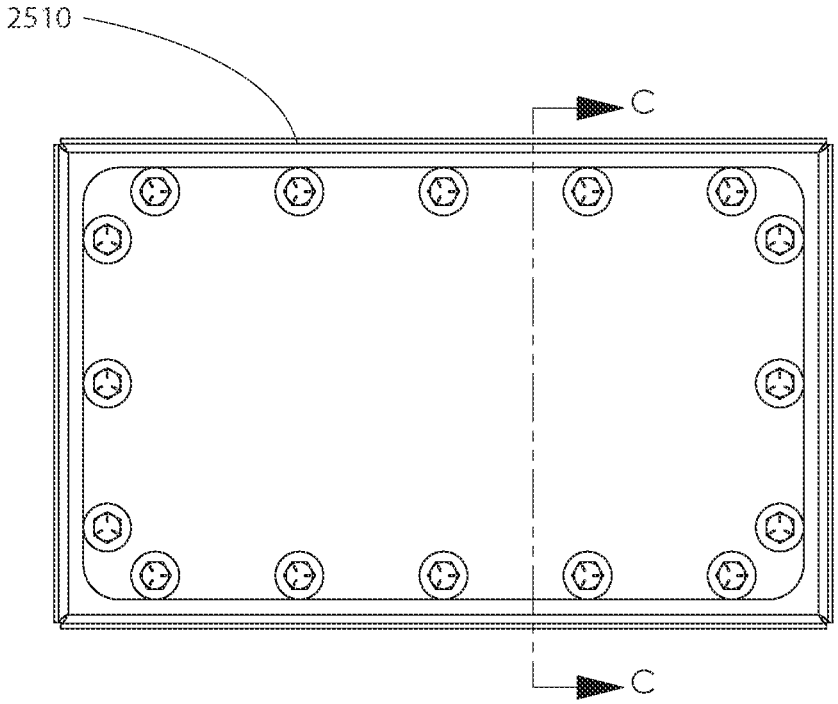
FIG. 26
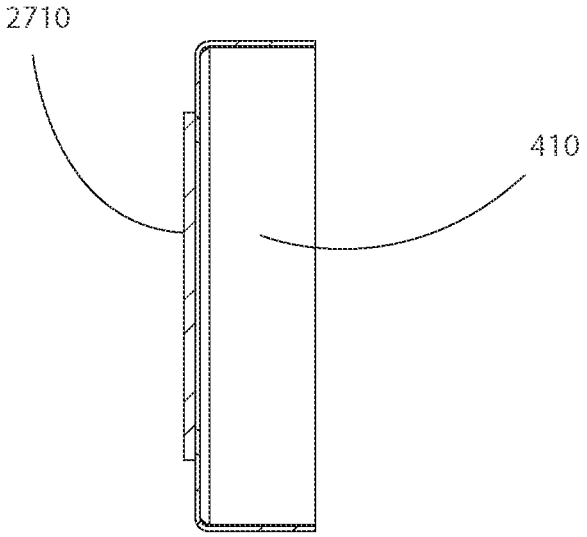
FIG. 27 SECTION C-C

SHIPPING AND STORAGE CONTAINER FOR PERISHABLE GOODS

This application claims the benefit of U.S. Provisional Application No. 62/436,532, filed Dec. 31, 2022, the contents of which are herein incorporated by reference.

FIELD

Embodiments herein relate to a shipping and storage container for perishable goods, such as agricultural products.

SUMMARY

The present disclosure is directed to a shipping and storage container for perishable goods, such as grain and produce.

In an embodiment, a shipping and storage container for the shipment of perishable goods, the shipping container is included having an enclosed area, at least one removable ventilation tube extending into the enclosed area, the ventilation tube in communication with the exterior of the container.

In an embodiment, the shipping container includes at least two ventilation tubes. In an embodiment, wherein ventilation tube is porous along its length. In an embodiment, the ventilation tubes have a closed end.

In an embodiment, the ventilation tubes rest on removable brackets resting on a floor of the enclosed area.

In an embodiment, the ventilation tubes are positioned within 6 inches of the bottom of the container. In an embodiment, the ventilation tubes are positioned within 12 inches of the bottom of the container. In an embodiment, the ventilation tubes are positioned within 18 inches of the bottom of the container. In an embodiment, the ventilation tubes are positioned within 24 inches of the bottom of the container.

In an embodiment, the ventilation tubes are removable.

In an embodiment, the ventilation tubes rest on brackets on the floor of the container without further modification of the floor. In an embodiment, the ventilation tubes connect to a flush port inside the container. In an embodiment, the ports fit within the profile of the container structure to maintain cargo space and use when the tubes are removed.

In an embodiment, wherein input ports on the container can be closed with a seal to return the container to a standard secure shipping container.

In an embodiment, the container can be configured to be substantially airtight to retain an inert gas.

In an embodiment, the ventilation tube is attachable to the exterior port with a quick release fastener.

In an embodiment, further can include a splitter attachment.

In an embodiment, the socket is flush with the exterior of the container.

In an embodiment, the ventilation tubes extend along the full length of the container.

In an embodiment, the ventilation tubes extend along the 90 percent of the length of the container.

In an embodiment, the ventilation tubes extend along at least 80 percent of the length of the container.

In an embodiment, the ventilation tubes extend along at least 70 percent of the length of the container.

In an embodiment, the ventilation tubes are made of steel. In an embodiment, the ventilation tubes are made of stainless steel.

In an embodiment, the container includes an exit port.

In an embodiment, the container includes an exit port opposite the location where the ventilation tube enters the exterior of the container.

In an embodiment, the exit port has a cover.

In an embodiment, the exit port has a screen to prevent entry of animals into the container.

In an embodiment, wherein container includes at least one fill port on its top surface.

In an embodiment, the fill port has a cover for sealing.

In an embodiment, further can include a heater in communication with the ventilation tube for pumping heated air into the container.

In an embodiment, further can include a cooler in communication with the ventilation tube for pumping cooled air into the container.

In an embodiment, further can include a dehumidifier in communication with the ventilation tube for pumping dehumidified air into the container.

In an embodiment, further can include a humidifier in communication with the ventilation tube for pumping humidified air into the container.

In an embodiment, further can include dumping doors positioned behind a main door.

In an embodiment, the dumping doors are sectional.

In an embodiment, the ventilation tubes can be combined into a single container for return shipping.

In an embodiment, wherein upon removal of the ventilation tubes the interior of the container complies w/standard container dimensions.

In an embodiment, further can include a removable bulkhead gate.

In an embodiment, the bulkhead gate is removable.

In an embodiment, the intake ports include fans secured permanently into the container walls.

In an embodiment, the bulkhead gate fits tight to back doors of the container but doesn't affect function of the back doors of the container.

In an embodiment, the bulkhead gate fits to the container by spring loaded pins.

In an embodiment, the bottom pins of the gate are releasable to function as a slow-release dump gate.

In an embodiment, wherein top pins of the bulkhead gate are releasable to convert the bulkhead gate to a ramp.

In an embodiment, further can include an external identification code.

In an embodiment, further can include a sensor to monitor the environment inside the shipping and storage container.

In an embodiment, further can include a temperature monitor.

In an embodiment, further can include a humidity monitor.

In an embodiment, further can include a light monitor.

In an embodiment, further can include a shock monitor.

In an embodiment, further can include a food traceability, security or sustainability tracking component.

In an embodiment, a shipping and storage container for the shipment of perishable goods, the shipping container is included having an enclosed area containing a top, a bottom, back wall, side walls, and a front gate, at least to permeable removable ventilation tubes extending into the enclosed area, the ventilation tubes in communication with the exterior of the container, the ventilation tubes secured to flush mounted ports mounted in the back wall of the container, the ports being substantially flush with the interior and exterior of the container.

In an embodiment, wherein ventilation tube is porous along its length.

In an embodiment, the ventilation tubes have a closed end.

In an embodiment, the ventilation tubes rest on removable brackets resting on a floor of the enclosed area.

In an embodiment, the ventilation tubes are positioned within 6 inches of the bottom of the container.

In an embodiment, the ventilation tubes are positioned within 12 inches of the bottom of the container.

In an embodiment, the ventilation tubes are positioned within 18 inches of the bottom of the container.

In an embodiment, the ventilation tubes are positioned within 24 inches of the bottom of the container.

In an embodiment, the ventilation tubes are removable.

In an embodiment, the ventilation tubes rest on brackets on the floor of the container without further modification of the floor.

In an embodiment, the ventilation tubes connect to a flush port inside the container.

In an embodiment, the ports fit within the profile of the container structure to maintain cargo space and use when the tubes are removed.

In an embodiment, wherein input ports on the container can be closed with a seal to return the container to a standard secure shipping container.

In an embodiment, the container can be configured to be substantially airtight to retain an inert gas.

In an embodiment, the ventilation tube is attachable to the exterior port with a quick release fastener.

In an embodiment, further can include a splitter attachment.

In an embodiment, the socket is flush with the exterior of the container.

In an embodiment, the ventilation tubes extend along the full length of the container. In an embodiment, the ventilation tubes extend along the 90 percent of the length of the container. In an embodiment, the ventilation tubes extend along at least 80 percent of the length of the container.

In an embodiment, the ventilation tubes extend along at least 70 percent of the length of the container.

In an embodiment, the ventilation tubes are made of steel In an embodiment, the ventilation tubes are made of stainless steel.

In an embodiment, the container includes an exit port. In an embodiment, the container includes an exit port opposite the location where the ventilation tube enters the exterior of the container.

In an embodiment, the exit port has a cover In an embodiment, the exit port has a screen to prevent entry of animals into the container. In an embodiment, wherein container includes at least one fill port on its top surface.

In an embodiment, wherein container includes more than one fill port on its top surface.

In an embodiment, the fill port has a cover for sealing.

In an embodiment, further can include a heater in communication with the ventilation tube for pumping heated air into the container. In an embodiment, further can include a cooler in communication with the ventilation tube for pumping cooled air into the container. In an embodiment, further can include a dehumidifier in communication with the ventilation tube for pumping dehumidified air into the container. In an embodiment, further can include a humidifier in communication with the ventilation tube for pumping humidified air into the container.

In an embodiment, further can include dumping doors positioned behind a main door.

In an embodiment, the dumping doors are sectional.

In an embodiment, the ventilation tubes can be combined into a single container for return shipping.

In an embodiment, wherein upon removal of the ventilation tubes the interior of the container complies w/standard container dimensions.

In an embodiment, further can include a removable bulkhead gate.

In an embodiment, the bulkhead gate is removable.

In an embodiment, the intake ports include fans secured permanently into the container walls.

In an embodiment, the bulkhead gate fits tight to back doors of the container but doesn't affect function of the back doors of the container.

In an embodiment, the bulkhead gate fits to the container by spring loaded pins.

In an embodiment, the bottom pins of the gate are releasable to function as a slow-release dump gate.

In an embodiment, wherein top pins of the bulkhead gate are releasable to convert the bulkhead gate to a ramp.

In an embodiment, further can include an external identification code.

In an embodiment, further can include a sensor to monitor the environment inside the shipping and storage container.

In an embodiment, further can include a temperature monitor.

In an embodiment, further can include a humidity monitor.

In an embodiment, further can include a light monitor.

In an embodiment, further can include a shock monitor.

In an embodiment, further can include a food traceability, security or sustainability tracking component.

BRIEF DESCRIPTION OF THE FIGURES

Aspects may be more completely understood in connection with the following FIGURES, in which:

FIG. 18 is an elevational view of a bulkhead for a shipping and storage container in accordance with various embodiments herein.

FIG. 19 is an elevational view of a bulkhead for a shipping and storage container in accordance with various embodiments herein.

FIG. 26 is an interior elevational view of a vent port for a shipping and storage container in accordance with various embodiments herein.

FIG. 27 is a side cross sectional view of a vent port for a shipping and storage container in accordance with various embodiments herein.

While embodiments are susceptible to various modifications and alternative forms, specifics thereof have been shown by way of example and drawings, and will be described in detail. It should be understood, however, that the scope herein is not limited to the particular aspects described. On the contrary, the intention is to cover modifications, equivalents, and alternatives falling within the spirit and scope herein.

DETAILED DESCRIPTION

In an embodiment, a shipping and storage container for the shipment of perishable goods, the shipping container is included having an enclosed area, at least one removable ventilation tube extending into the enclosed area, the ventilation tube in communication with the exterior of the container.

Figure 1:
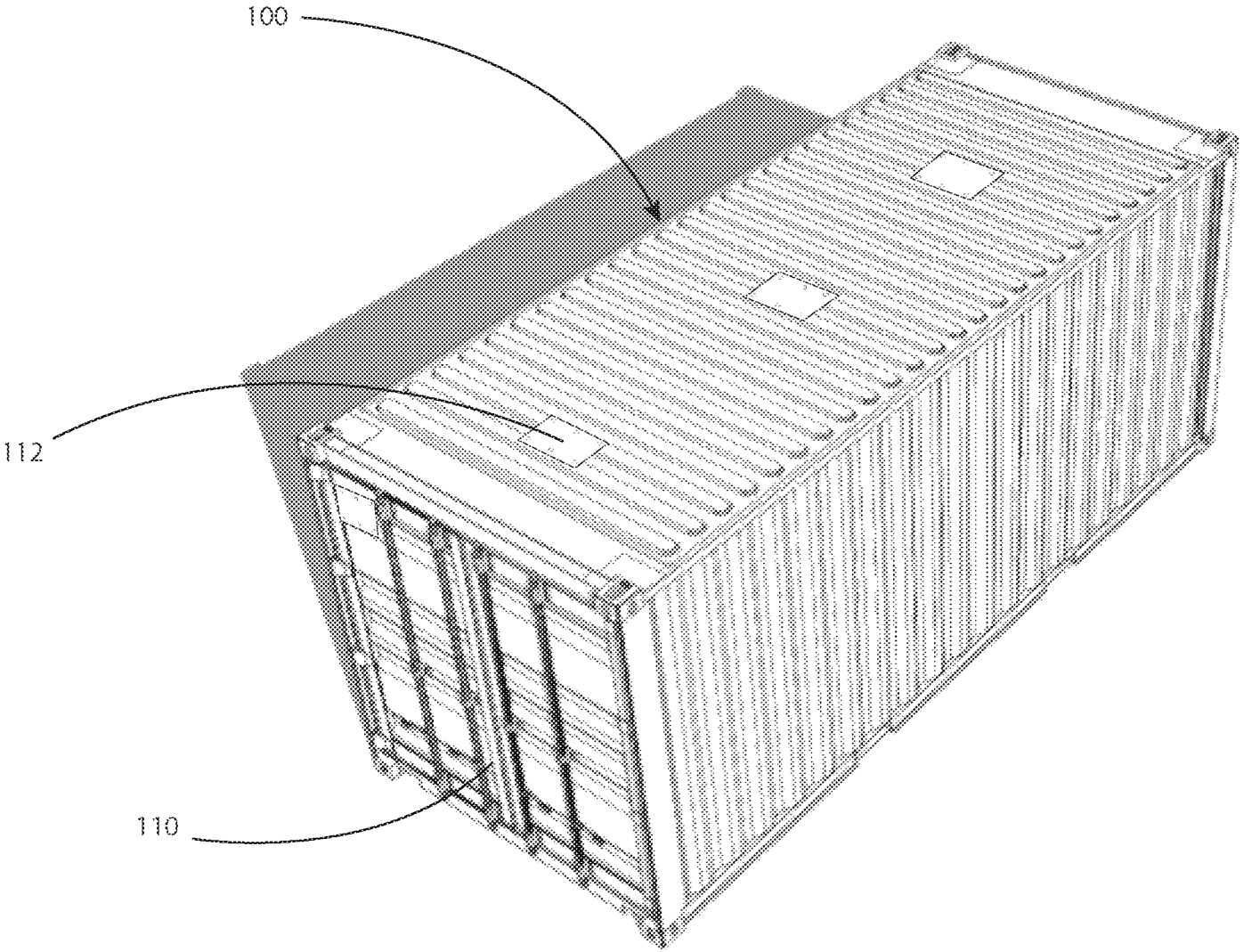
FIG. 1 is a perspective view of a shipping and storage container made in accordance with various embodiments herein.

FIG. 1 is a perspective view of a shipping and storage container 100 made in accordance with various embodiments herein. The shipping and storage container 100 includes a front end with a door or doors 110 that open and allow access to the interior of the shipping and storage container. The top of the shipping and storage container 100 includes fill ports 112, which have covers installed in the photo. The covers are removable for filling the container with perishable ingredients, such as grain.

Figure 2:
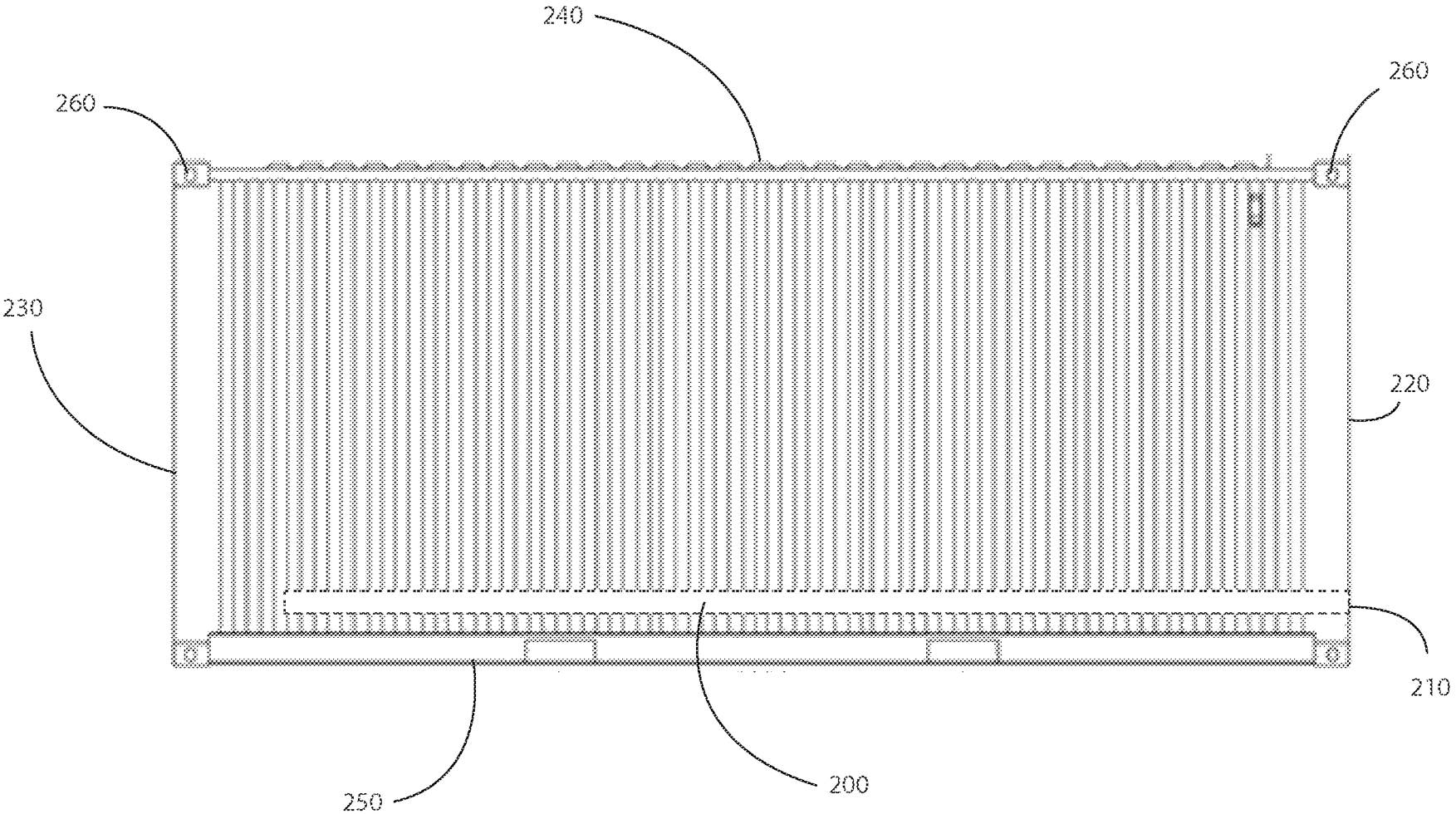
FIG. 2 is a side partial cross-sectional view of a shipping and storage container in accordance with various embodiments herein.

FIG. 2 is a side partial cross-sectional view of a shipping and storage container 100 in accordance with various embodiments herein. The shipping and storage container 100 includes a back wall 220, a front end (with a door, not shown) 230, a top 240, a bottom 250, and various fastening points 260 for securing shipping and storage container 100. In addition, shown in dotted lines is a ventilation tube 200 for delivering over various gases into the interior of the shipping and storage container 100, such as hot air, cool air, humidified air, dehumidified air, ambient air, or an inert gas. In addition, a port 210 is shown, the port 210 providing access through the back wall 220 of the shipping and storage container 100 to allow gases to be pumped through the back wall 220 and into the ventilation tube 200.

Figure 3:
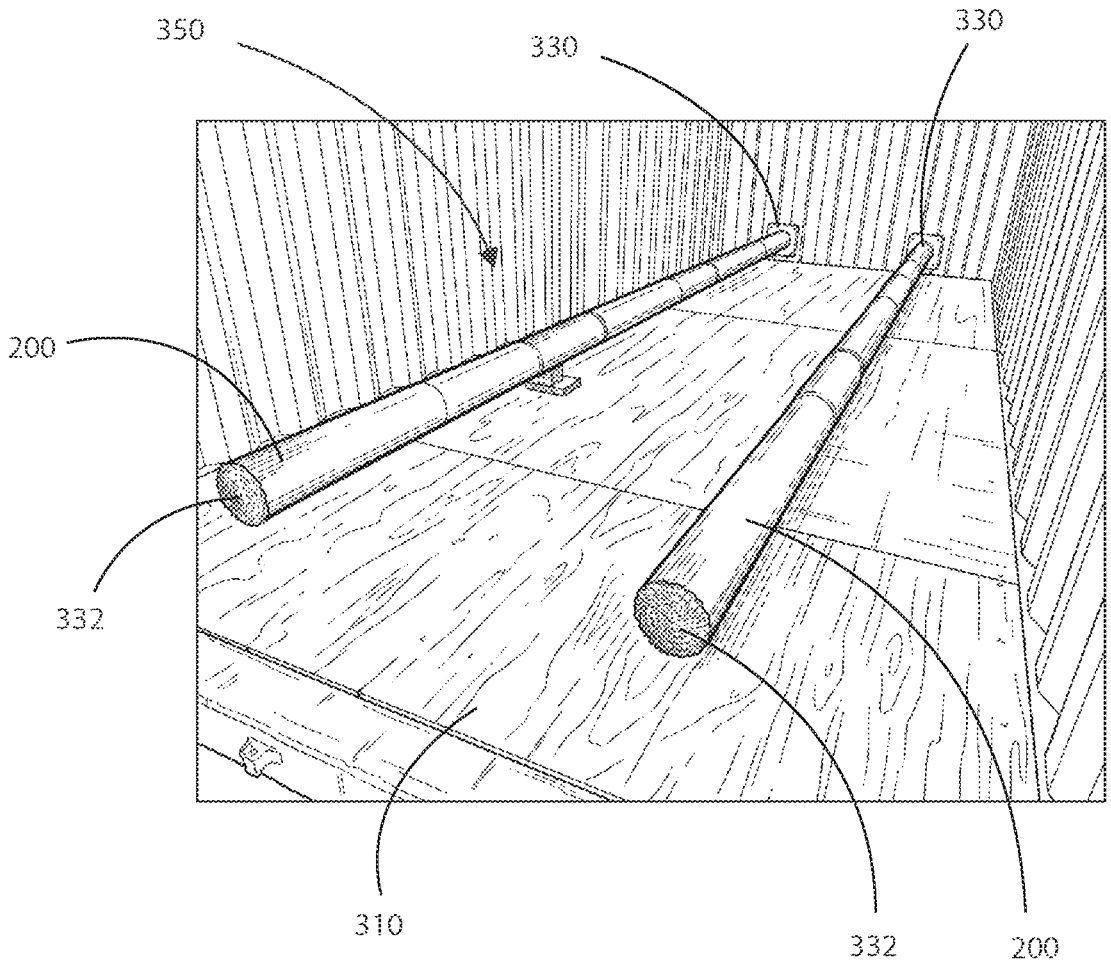
FIG. 3 is an end perspective view of the interior of a shipping and storage container in accordance with various embodiments herein.

FIG. 3 is an end perspective view of the interior of a shipping and storage container 100 in accordance with various embodiments herein, showing two ventilation tubes 200 positioned near the bottom 310 of the interior 350 of the shipping and storage container 100. The ventilation tubes 200 include closed ends 332, open ends 330 connected to the back-end wall of the shipping and storage container 100.

Figure 4:
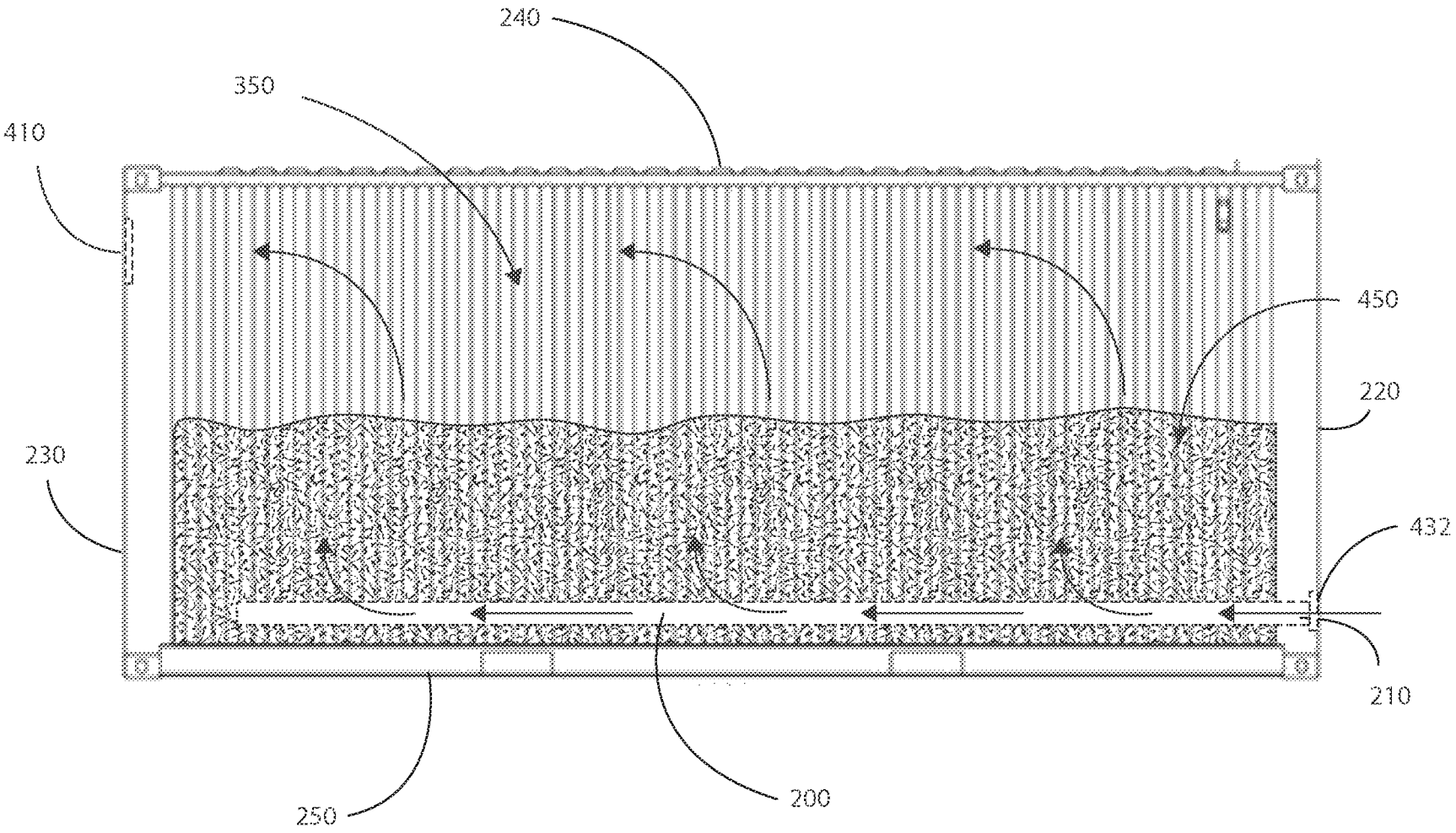
FIG. 4 is a side cut-away view of the interior of a shipping and storage container in accordance with various embodiments herein.

FIG. 4 is a side cut-away view of the interior of a shipping and storage container 100 in accordance with various embodiments herein, showing the container partially filled with a perishable material 450, such grain, fresh produce, or other agricultural products. Air or various gases can be pumped into the container through port 210 and then into ventilation tube, through the perishable material 450 and then out through exit vent 410. In this way the perishable material 450 can be cooled, heated, dried, hydrated, etc. depending upon the need. For example, if the perishable material 450 has too much moisture, it is possible to deliver dried air through the container (along the arrows showing general airflow) to dry the perishable material 450. Similarly, the perishable material 450 can be cooled, heated, hydrated or otherwise modified as desired.

Figure 5:
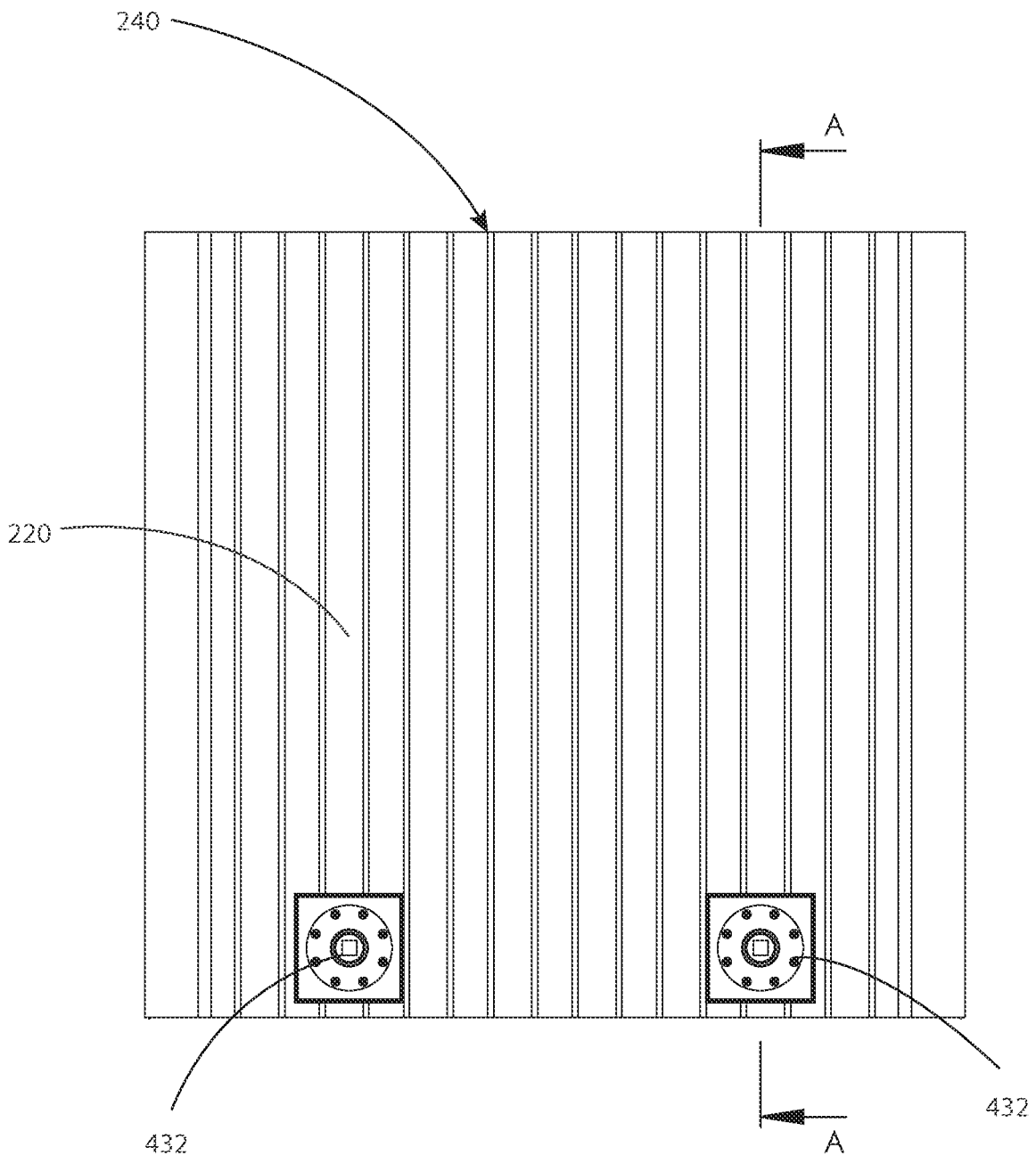
FIG. 5 is a is a rear end view of a shipping and storage container in accordance with various embodiments herein.

FIG. 5 is a is a rear end view of a shipping and storage container in accordance with various embodiments herein, showing two inlet ports 432, one for each of the ventilation tubes 200 (not shown). The number of inlet ports 432 will generally be equal to the number of ventilation tubes 200, thus if two ventilation tubes 200 are used, then two inlet ports 432 will be used. Similarly, if three ventilation tubes 200 are used, then more than one inlet port 432 will be used.

Figure 6:
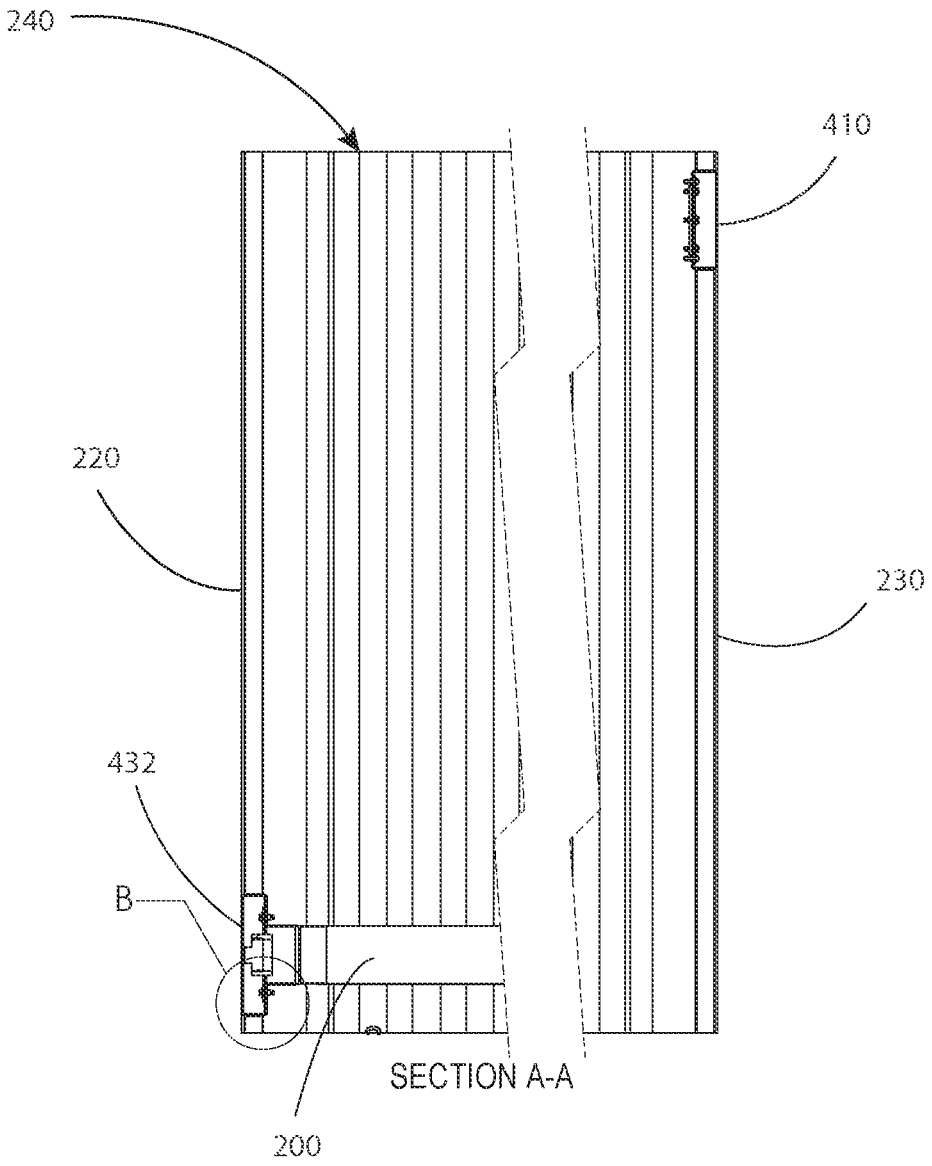
FIG. 6 is a side partial view of a shipping and storage container in accordance with various embodiments herein.

FIG. 6 is a side partial view of a shipping and storage container 100 in accordance with various embodiments herein, showing a inlet port 432, ventilation tube 200, and exit vent 410.

Figure 7:
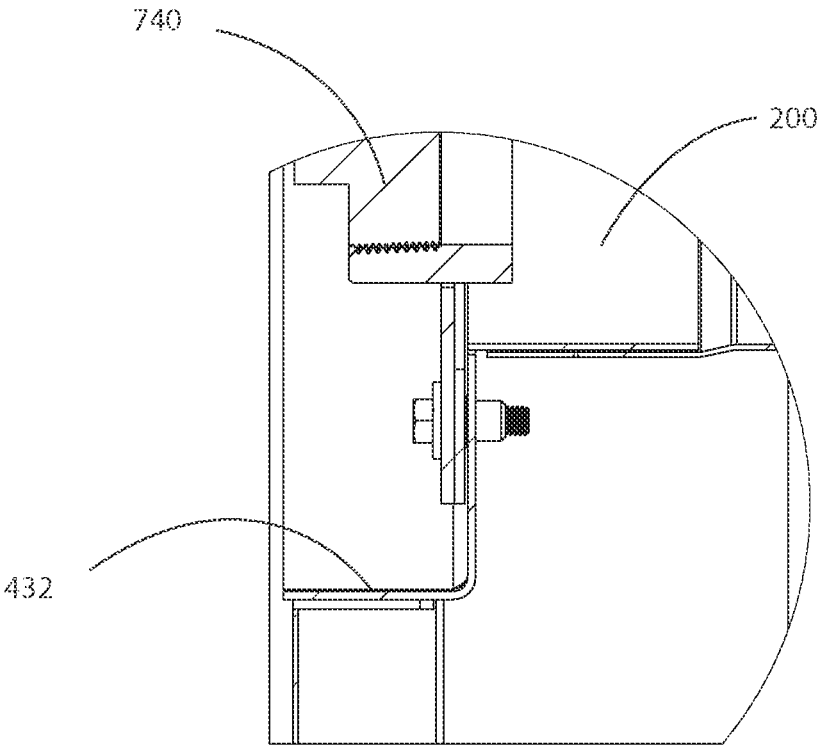
FIG. 7 is a detail close-up cross-sectional view of the lower rear of a shipping and storage container in accordance with various embodiments herein, showing portions of the junction for the port leading into the container.

FIG. 7 is a detail close-up cross-sectional view of the lower rear of a shipping and storage container 100 in accordance with various embodiments herein, showing portions of the junction for the inlet port 432 leading into the storage container 100, including a removable plug 740. It will be appreciated that the inlet port 432 is generally configured so that it is flush, or nearly flush, with the interior and exterior walls of the shipping and storage container 100. Thus, the shipping and storage container can be returned to normal use for all sorts of shipping (such as international shipping of non-perishable goods) by removing of the ventilation tubes because the primary dimensions of the shipping container have not been modified, allowing for standard loading of the shipping and storage containers on transport vehicles (trains, ships, trucks) and at storage facilities (docks, etc.).

Figure 8:
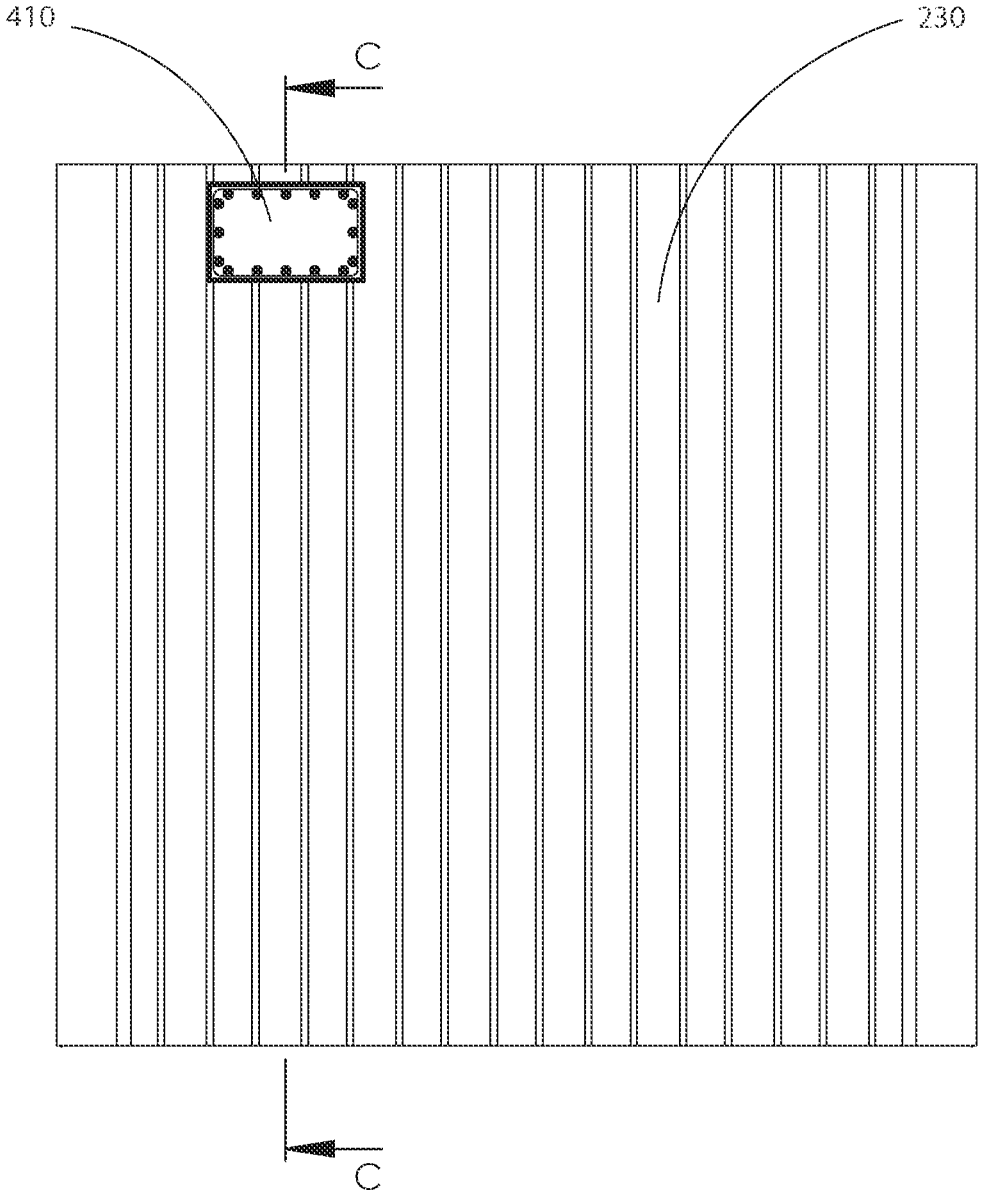
FIG. 8 is a front elevational view of a shipping and storage container in accordance with various embodiments herein.

FIG. 8 is a front elevational view of a shipping and storage container 100 in accordance with various embodiments herein, including an exit vent 410. In FIG. 8 the exit vent 410 is closed with a cover, such as for shipping or some storage. When being ventilated a plate covering the exit vent 410 is removed to allow air to pass through (although there is typically a mesh screen in place to prevent entry into the container by rodents, birds, etc.

Figure 9:
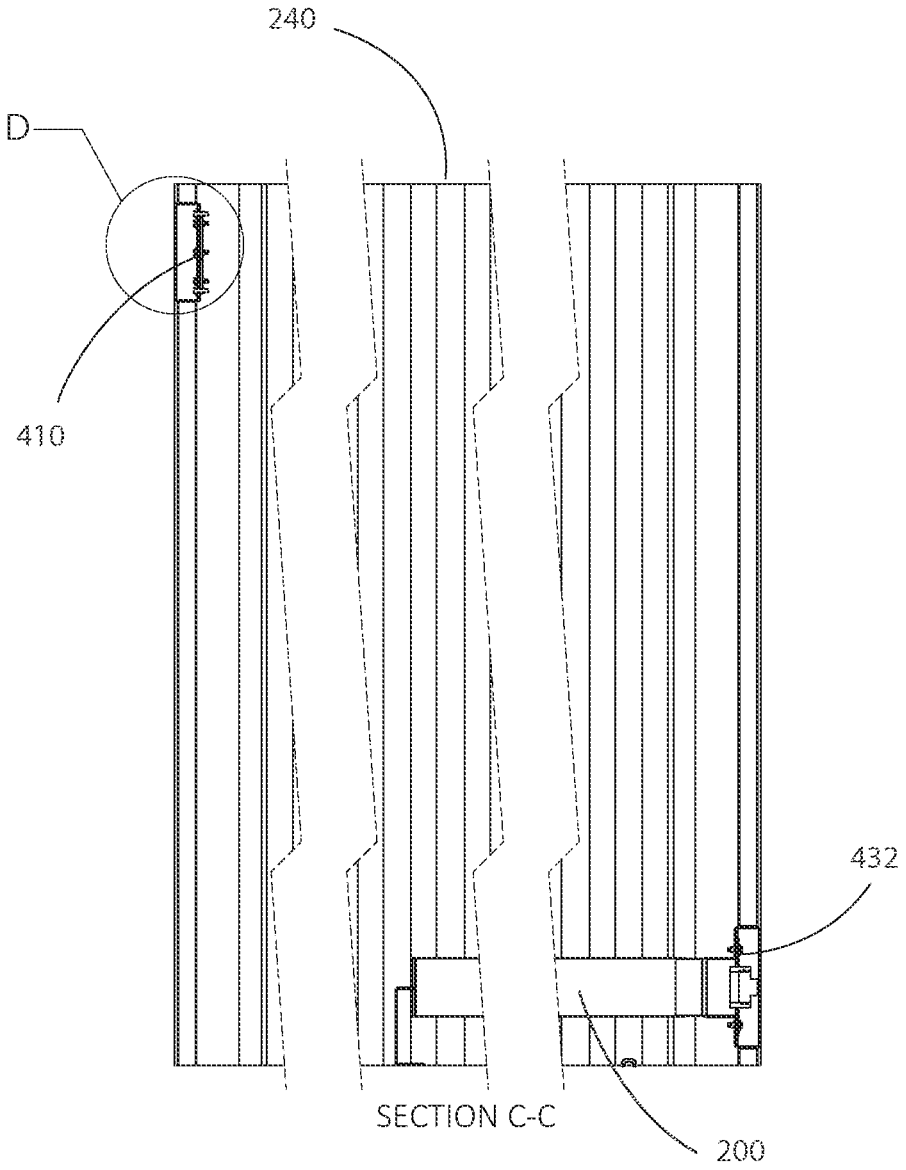
FIG. 9 is a side partial view of a shipping and storage container in accordance with various embodiments herein.

FIG. 9 is a side partial view of a shipping and storage container 100 in accordance with various embodiments herein, again showing an inlet port 432, a ventilation tube 200, and an exit vent 410.

Figure 10:
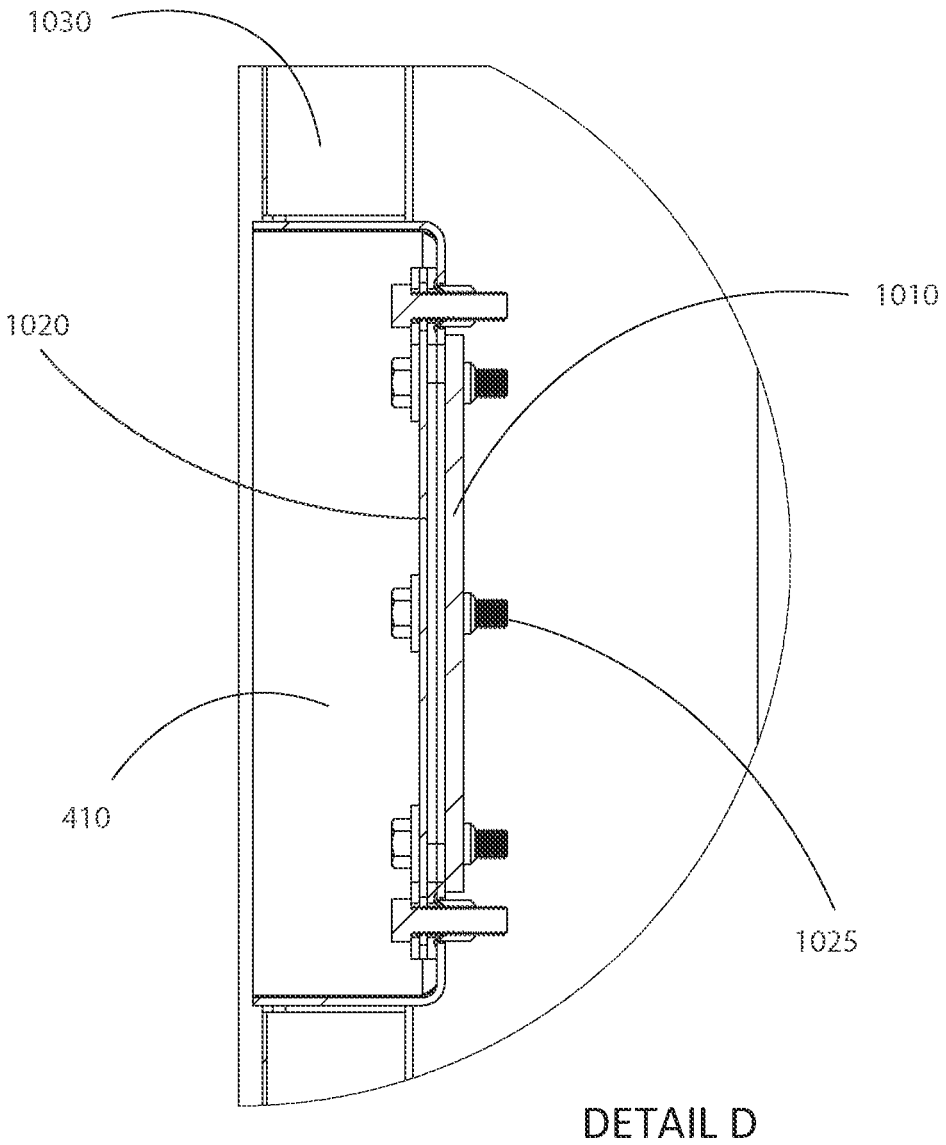
FIG. 10 is a detail close-up cross-sectional view of a shipping and storage container in accordance with various embodiments herein, showing a rear vent.

FIG. 10 is a detail close-up cross-sectional view of a shipping and storage container in accordance with various embodiments herein, showing an exit vent 410, including screen 1020, cover 1010 and bolt 1025.

Figure 11:
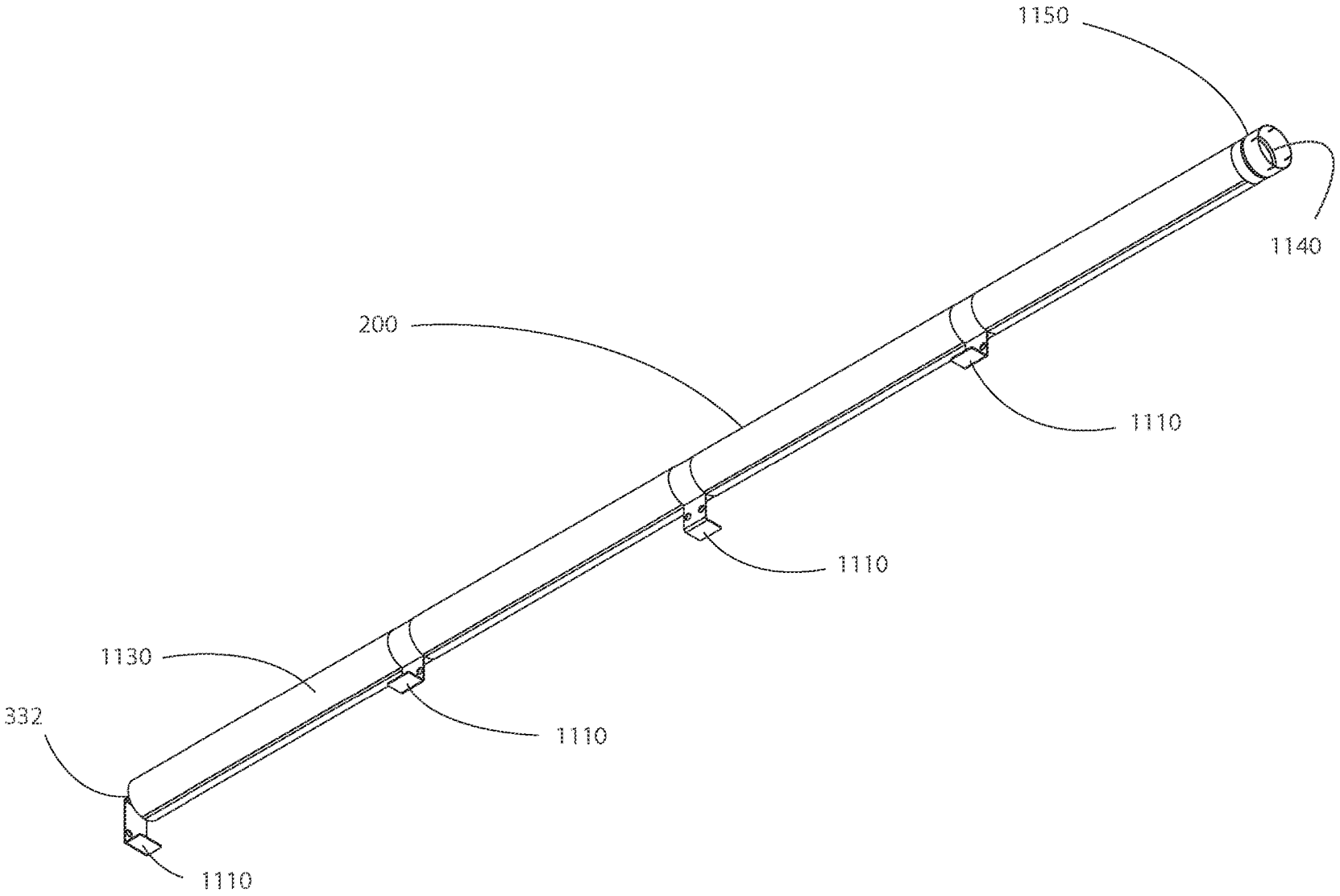
FIG. 11 is a perspective view of a manifold tube for a shipping and storage container in accordance with various embodiments herein, the manifold tube shown removed from the shipping and storage container.

FIG. 11 is a perspective view of a manifold ventilation tube 200 for a shipping and storage container in accordance with various embodiments herein, the manifold ventilation tube 200 shown removed from the shipping and storage container. The manifold ventilation tube 200 includes an open end 1140 and a closed and 332. The manifold ventilation tube 200 includes an elongate portion 1130 that has perforations in it to promote flow of air into materials within the container (such as grain) for drying (or other climate control). A series of legs 1110 extend from the bottom of the manifold ventilation tube 200 to hold it off the bottom of the shipping and storage container. The legs 1110 are typical free-floating on the floor (not attached) of the container so as to allow the easy removal of the manifold ventilation tube 200, such as to convert the container to other uses (normal shipping of non-bulk goods).

Figure 12:
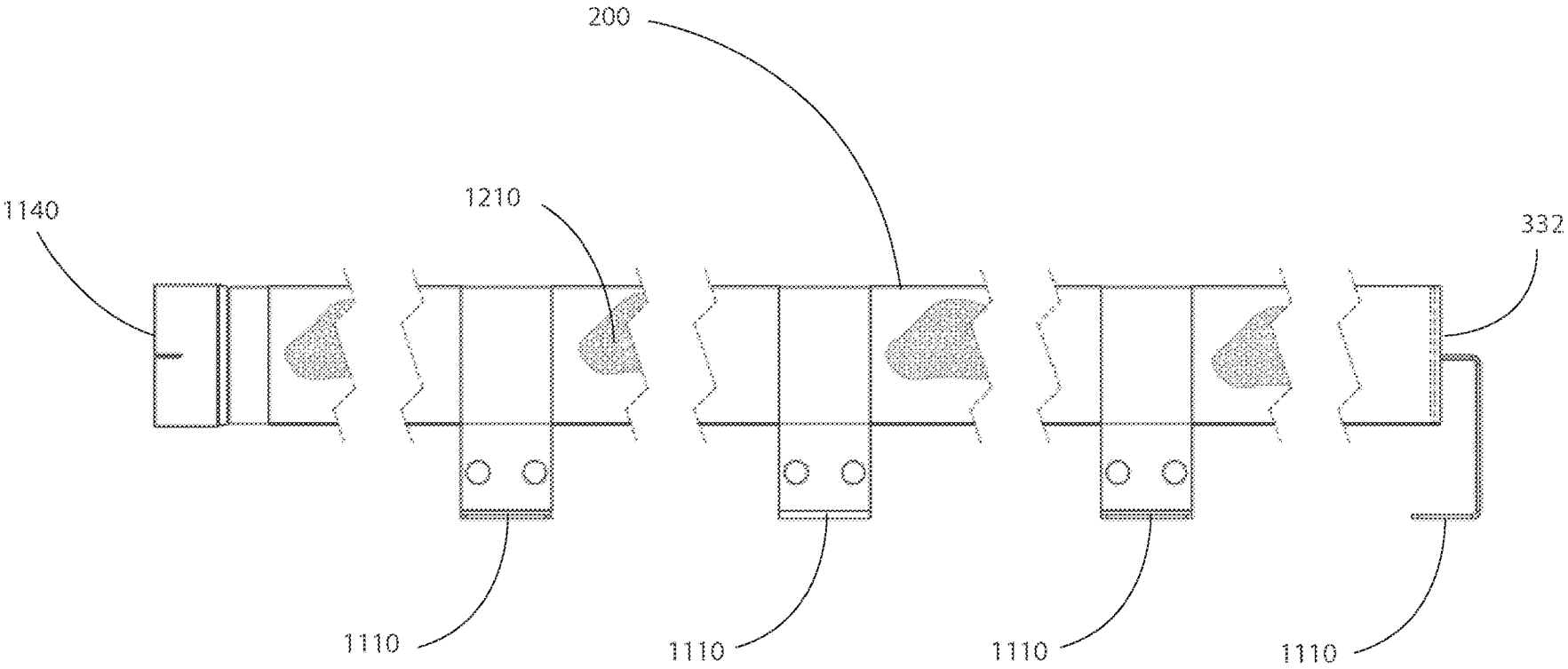
FIG. 12 is a partial side elevational view of a manifold tube for a shipping and storage container in accordance with various embodiments herein.

FIG. 12 is a partial side elevational view of a manifold ventilation tube 200 for a shipping and storage container in accordance with various embodiments herein, showing perforated area 1210.

Figure 13:
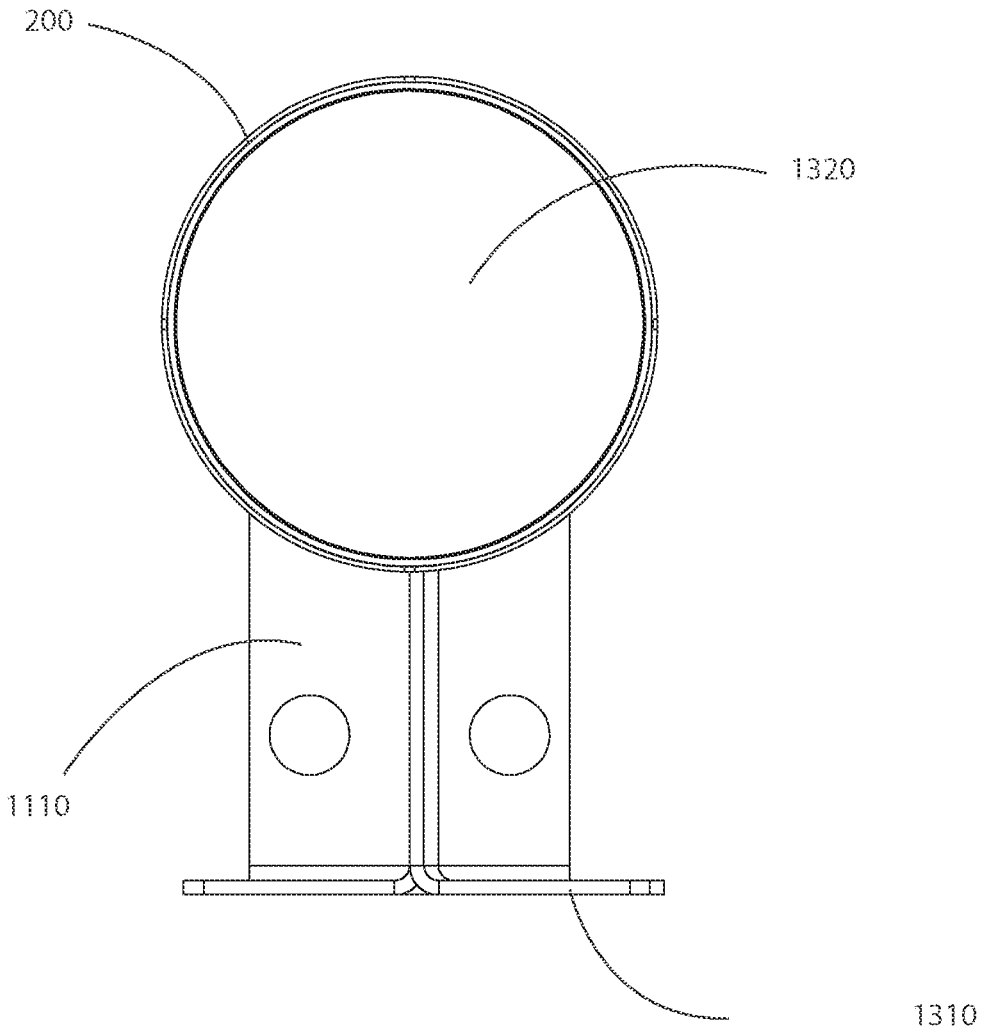
FIG. 13 is an end cross sectional view of a manifold tube for a shipping and storage container in accordance with various embodiments herein.

FIG. 13 is an end cross sectional view of a manifold ventilation tube 200 for a shipping and storage container in accordance with various embodiments herein, including interior 1320 (into which air can be pumped) as well as feet 1310 on legs 1110.

Figure 14:
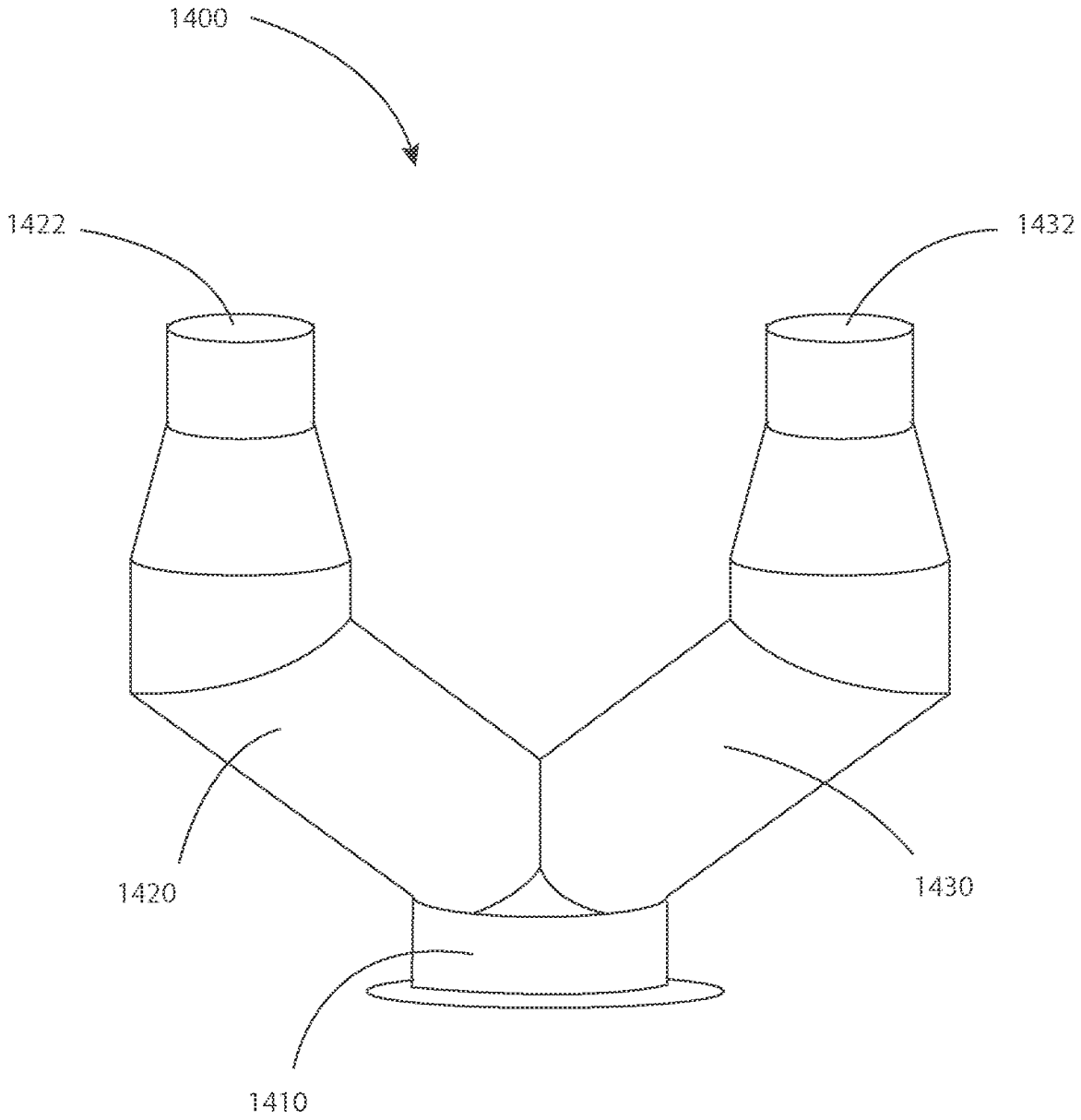
FIG. 14 is a top elevational view of an external air distribution splitting manifold for delivering air into a manifold of a shipping and storage container in accordance with various embodiments herein.
Figure 15:
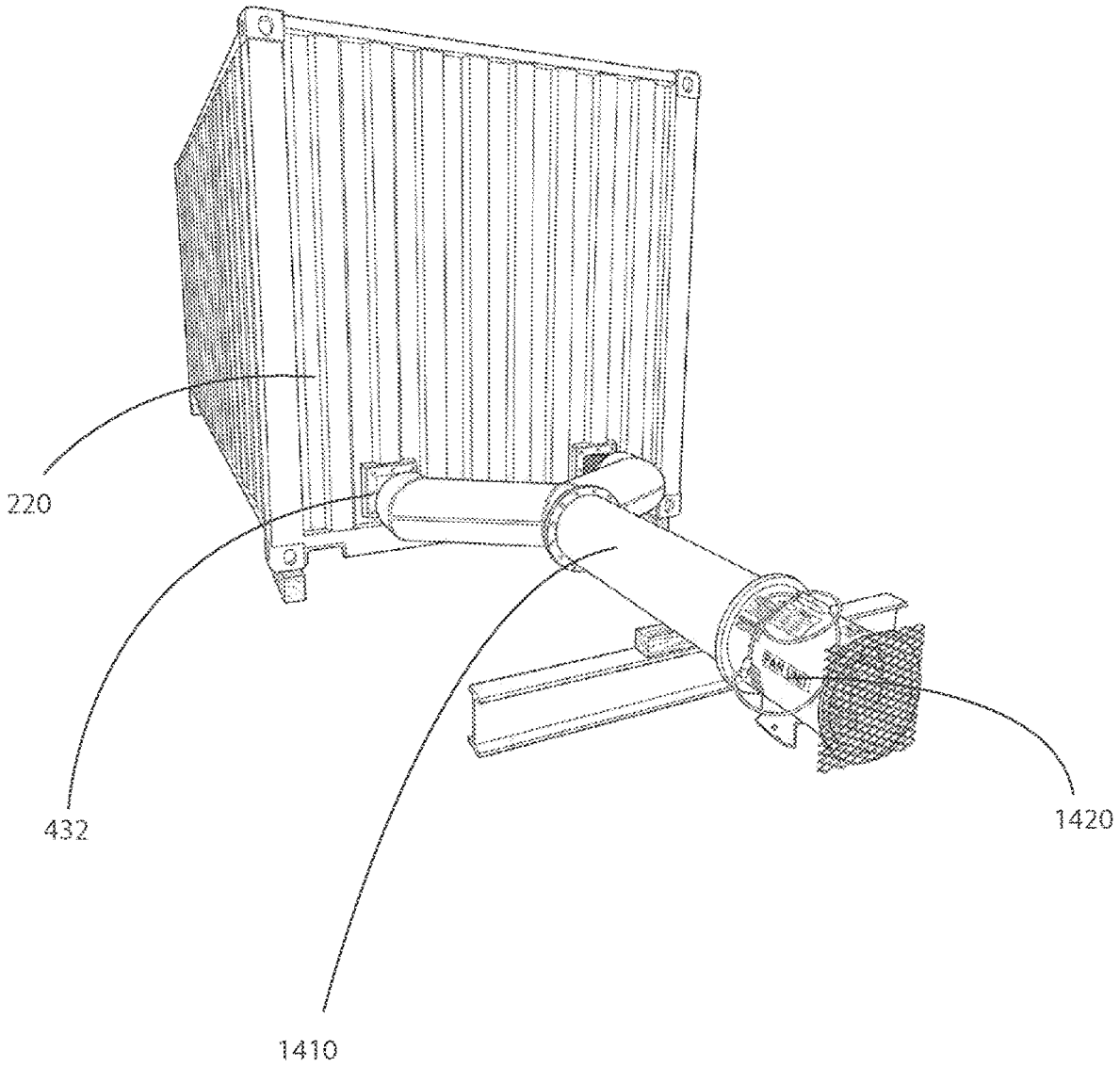
FIG. 15 is a perspective view of a shipping and storage container, air distribution splitting manifold, and air handler in accordance with various embodiments herein.
Figure 16:
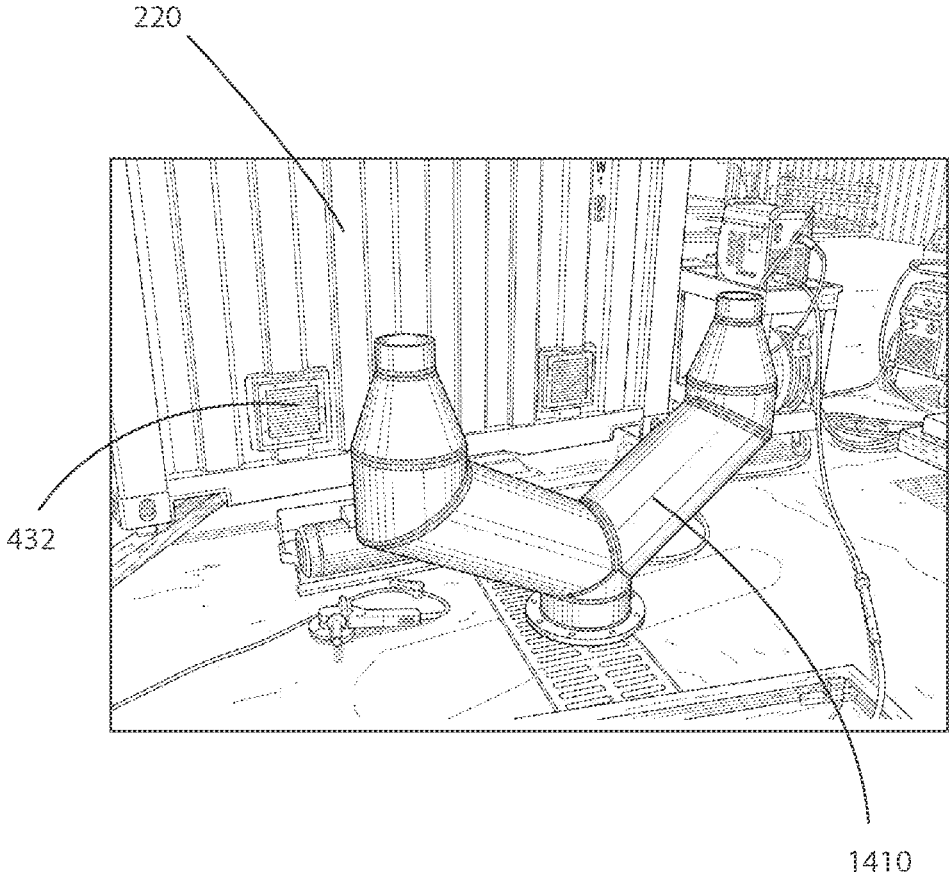
FIG. 16 is a perspective view of an air distribution splitting manifold in accordance with various embodiments herein.

FIG. 14 is a top elevational view of an external air distribution splitting manifold 1400 for delivering air into a manifold of a shipping and storage container in accordance with various embodiments herein. The splitting manifold 1400 includes an inlet portion 1410, first branch leading to outlet 1422, and second branch 1430 leading to second outlet 1432. FIG. 15 is a perspective view of a shipping and storage container back wall 220, air distribution splitting manifold 1410, and air handler 1420 in accordance with various embodiments herein. FIG. 16 is a perspective view of an air distribution splitting manifold in accordance with various embodiments herein.

Figure 17:
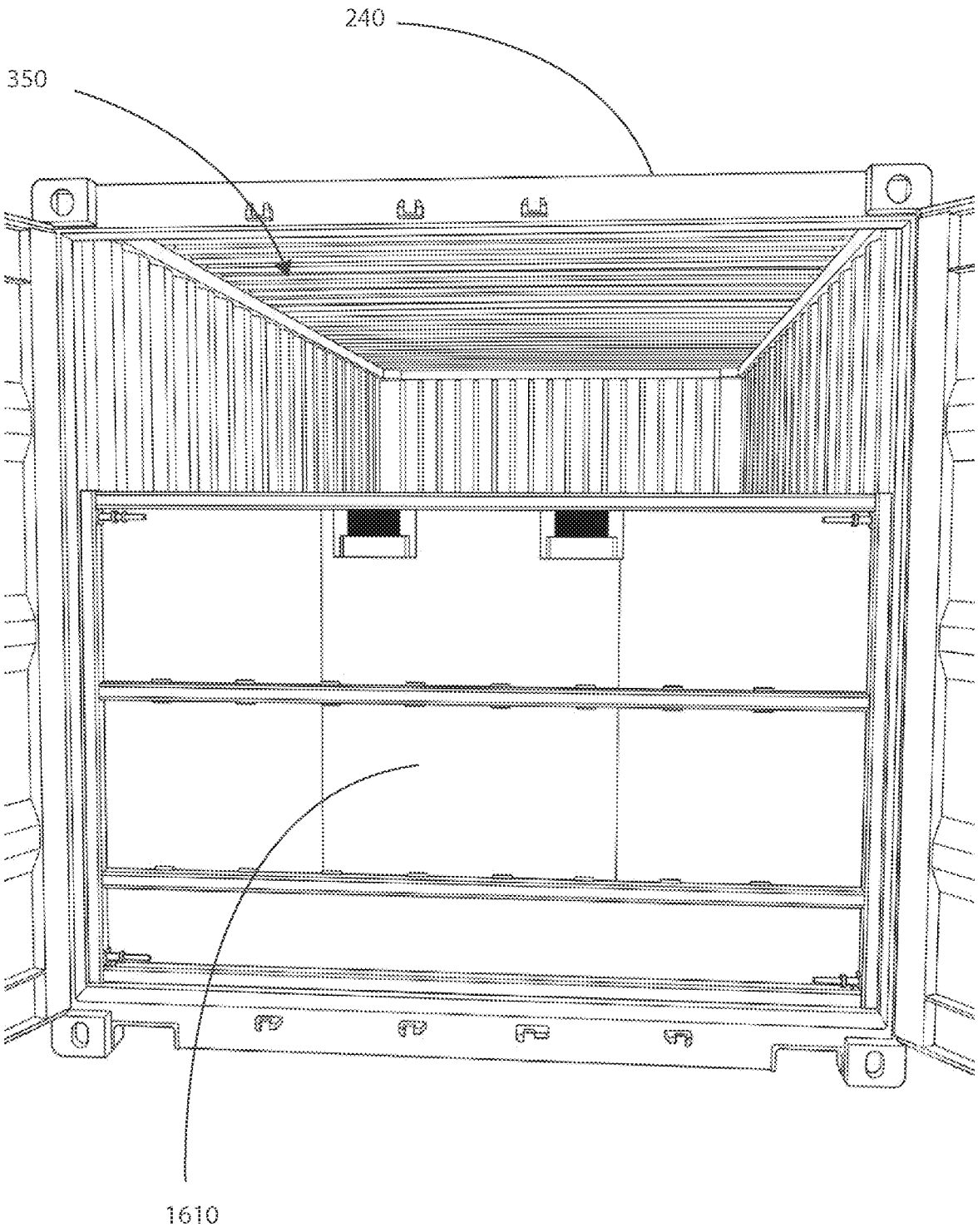
FIG. 17 is a rear view of a shipping and storage container in accordance with various embodiments herein, showing a bulkhead installed.

FIG. 17 is a rear view of a shipping and storage container in accordance with various embodiments herein, showing a bulkhead 1610 installed.

FIG. 18 is an elevational view of a bulkhead 1610 for a shipping and storage container in accordance with various embodiments herein, including pins 1810 for securing the bulkhead into the container. FIG. 19 is an elevational view of a bulkhead 1610 for a shipping and storage container in accordance with various embodiments herein.

Figure 20:
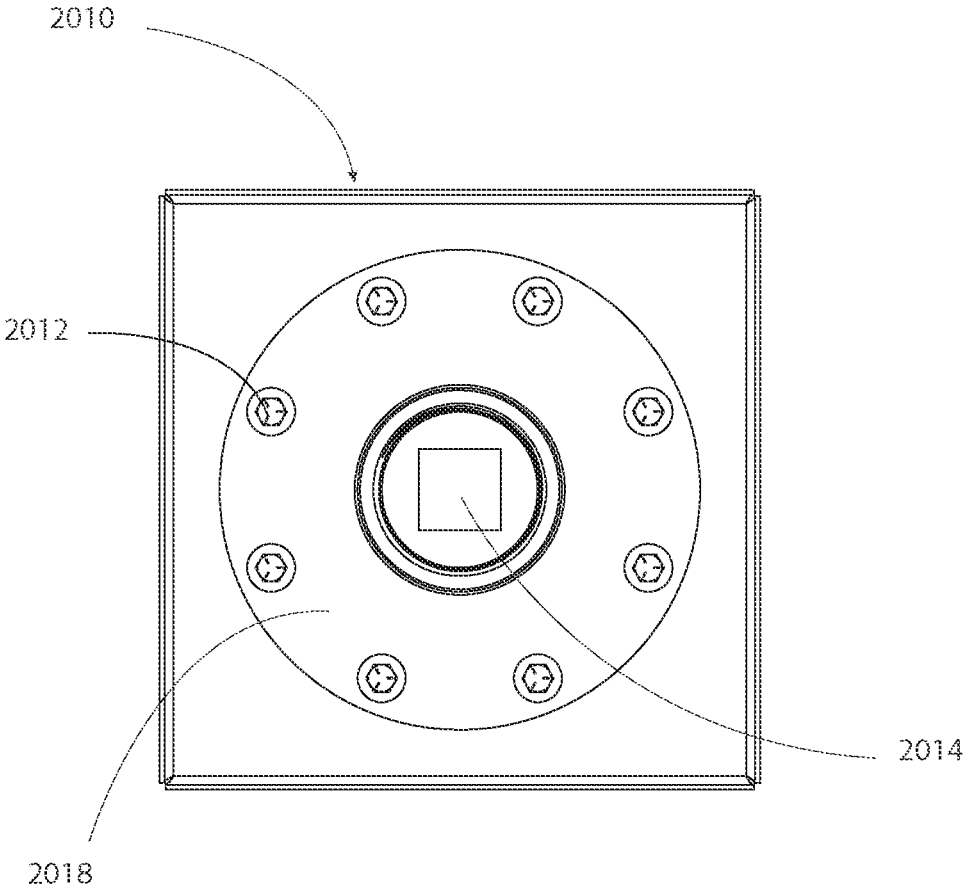
FIG. 20 is an outside elevational view of a fill port for a shipping and storage container in accordance with various embodiments herein.
Figure 21:
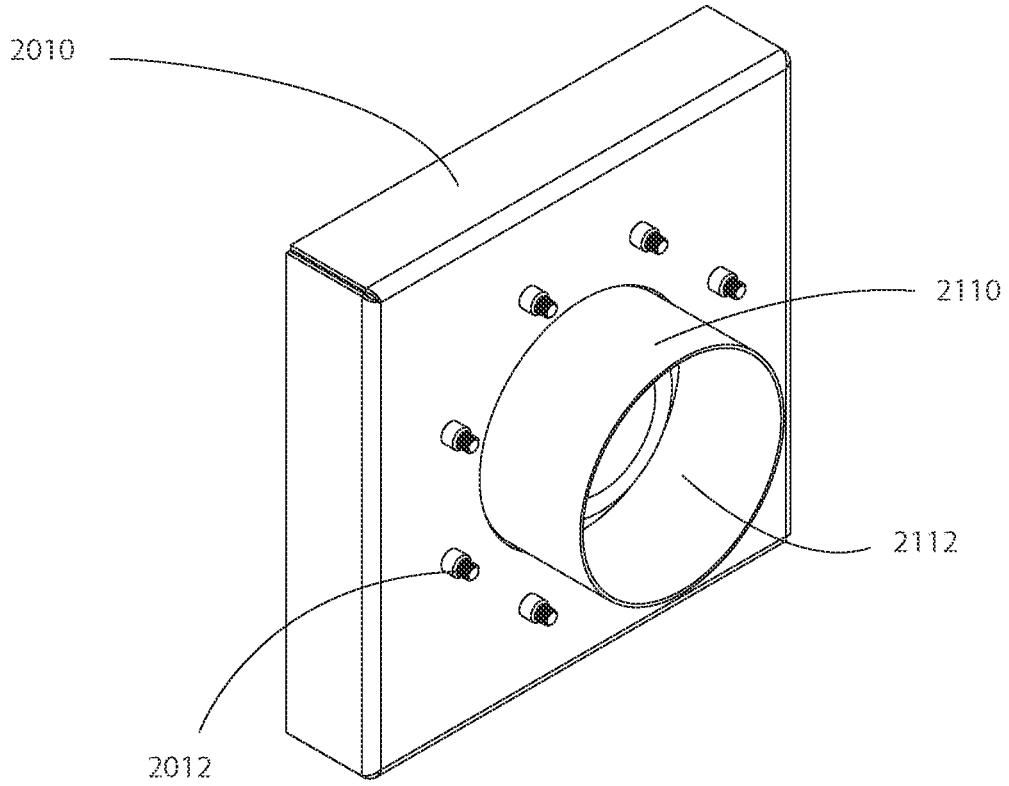
FIG. 21 is an interior perspective view of a fill port for a shipping and storage container in accordance with various embodiments herein.
Figure 22:
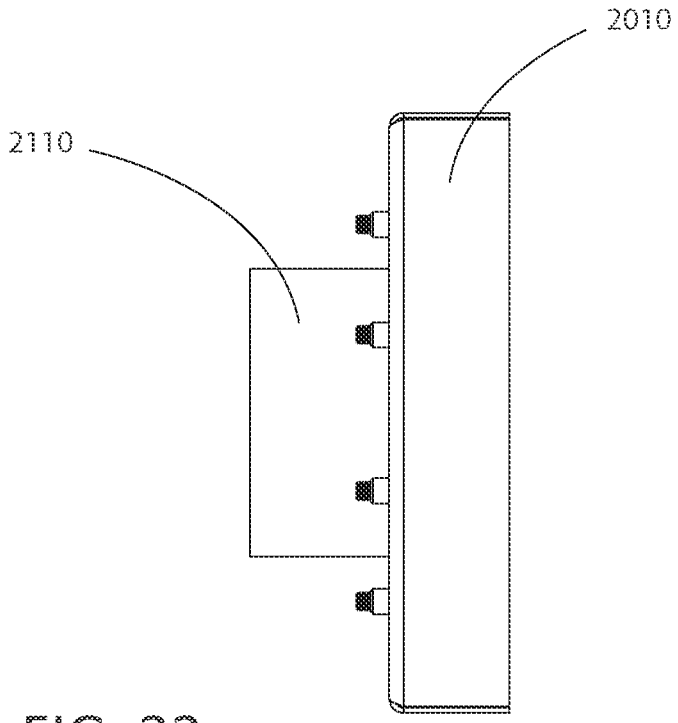
FIG. 22 is a side elevational view of a fill port for a shipping and storage container in accordance with various embodiments herein.

FIG. 20 is an outside elevational view of a fill port 2010 for a shipping and storage container in accordance with various embodiments herein, showing a flange 2018, bolts 2012, and a plug 2014. FIG. 21 is an interior perspective view of a fill port 2010 for a shipping and storage container in accordance with various embodiments herein, including interior coupling portion 2110 with interior section 2112 for receiving a manifold ventilation tube 200 (not shown). FIG. 22 is a side elevational view of a fill port 2010 for a shipping and storage container in accordance with various embodiments herein, including coupling portion 2110*n*.

Figure 23:
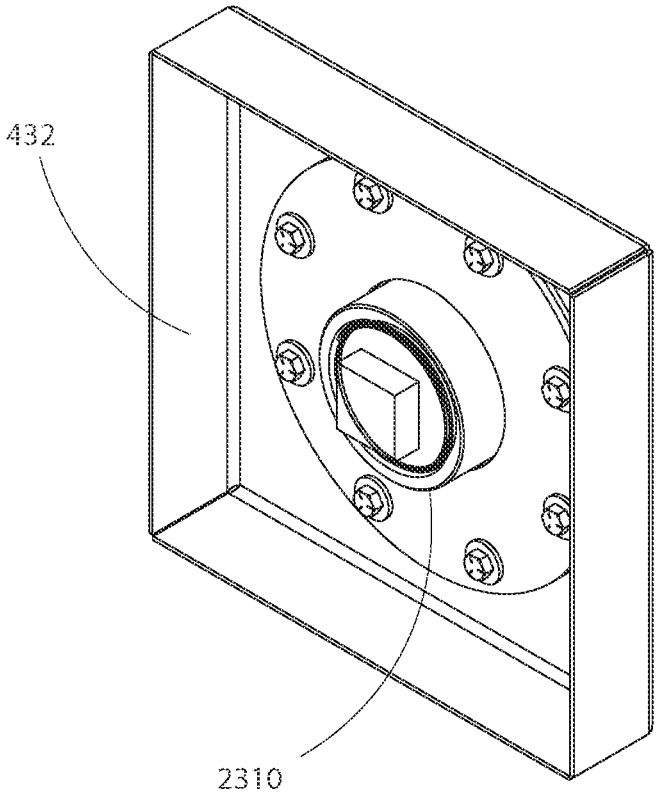
FIG. 23 is an exterior perspective view of a fill port for a shipping and storage container in accordance with various embodiments herein.
Figure 24:
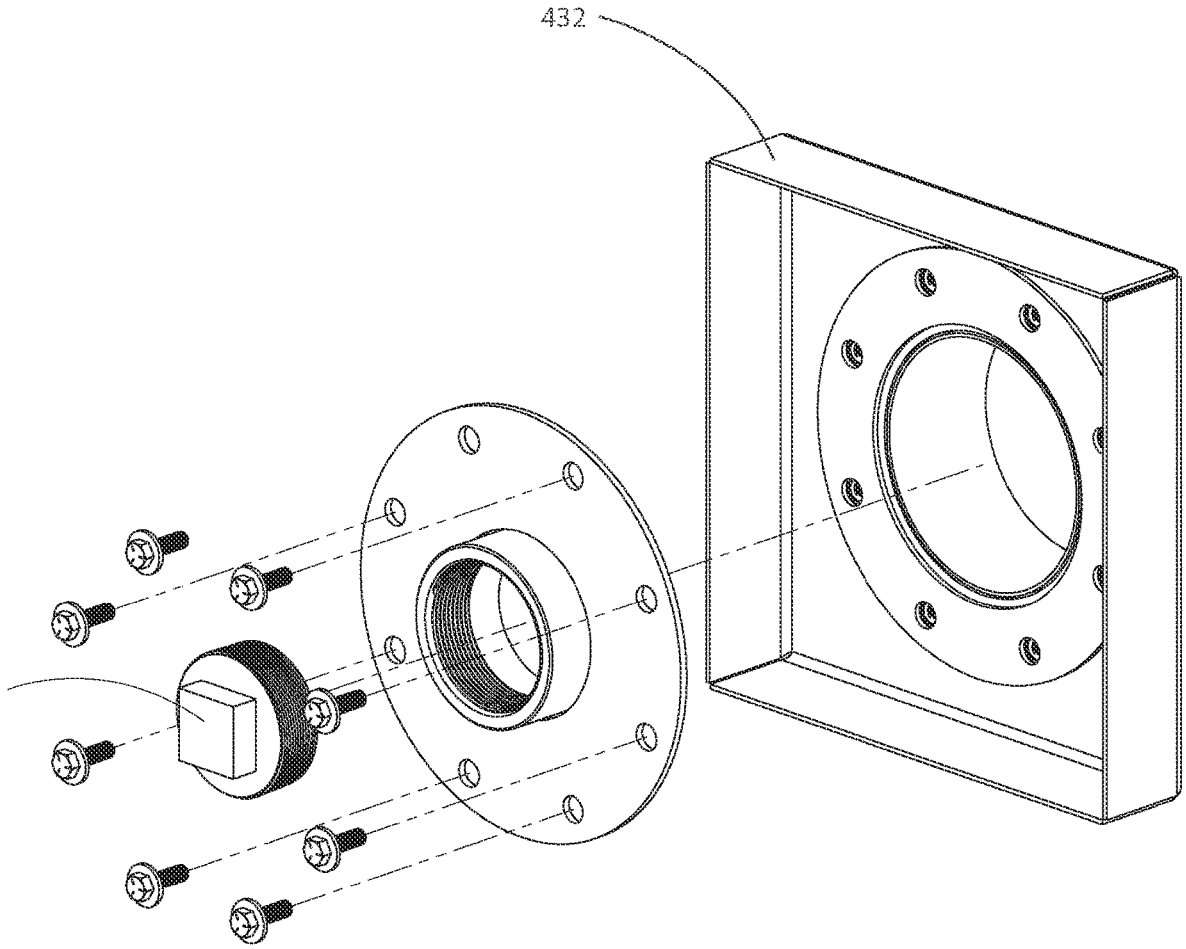
FIG. 24 is an exploded exterior perspective view of a shipping and storage container in accordance with various embodiments herein.

FIG. 23 is an exterior perspective view of a fill port for a shipping and storage container in accordance with various embodiments herein, showing an exterior coupling portion 2310 for receiving air (such as from a manifold connected to an air handler). FIG. 24 is an exploded exterior perspective view of a fill port in accordance with various embodiments herein.

Figure 25:
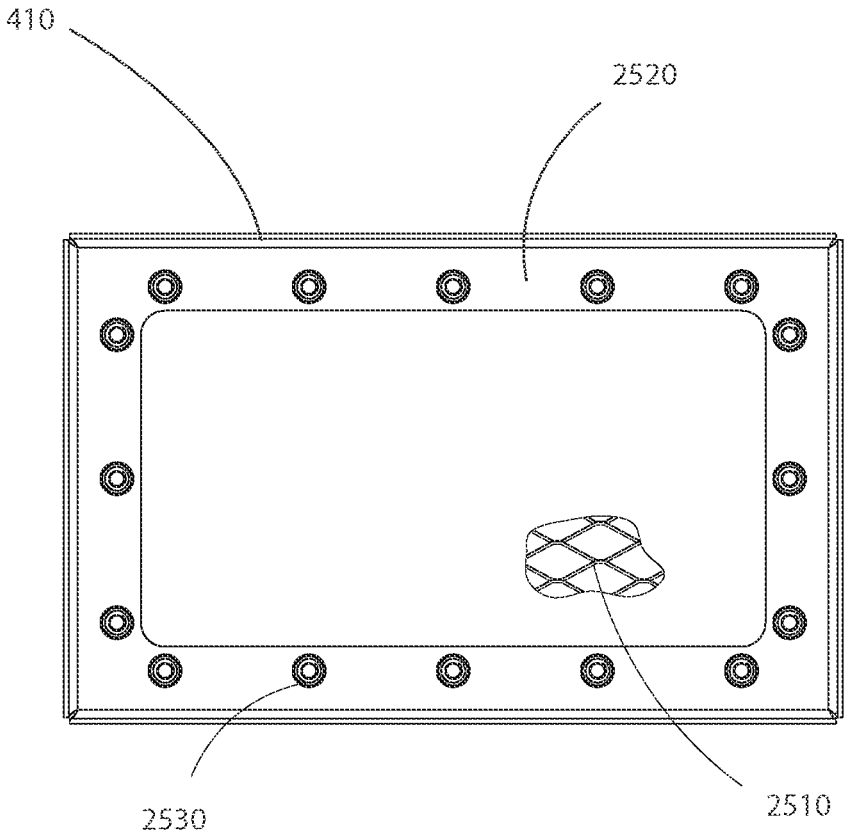
FIG. 25 is an exterior elevational view of a vent port for a shipping and storage container in accordance with various embodiments herein, showing a partial cut-away.
Figure 28:
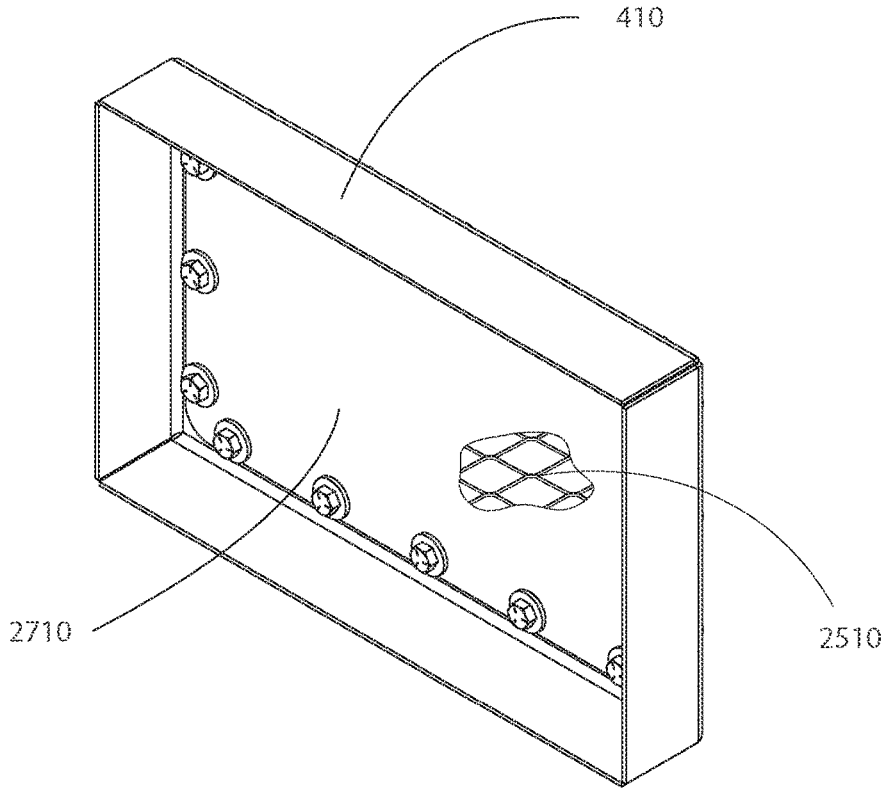
FIG. 28 is a exterior view of a vent port for a shipping and storage container in accordance with various embodiments herein.
Figure 29:
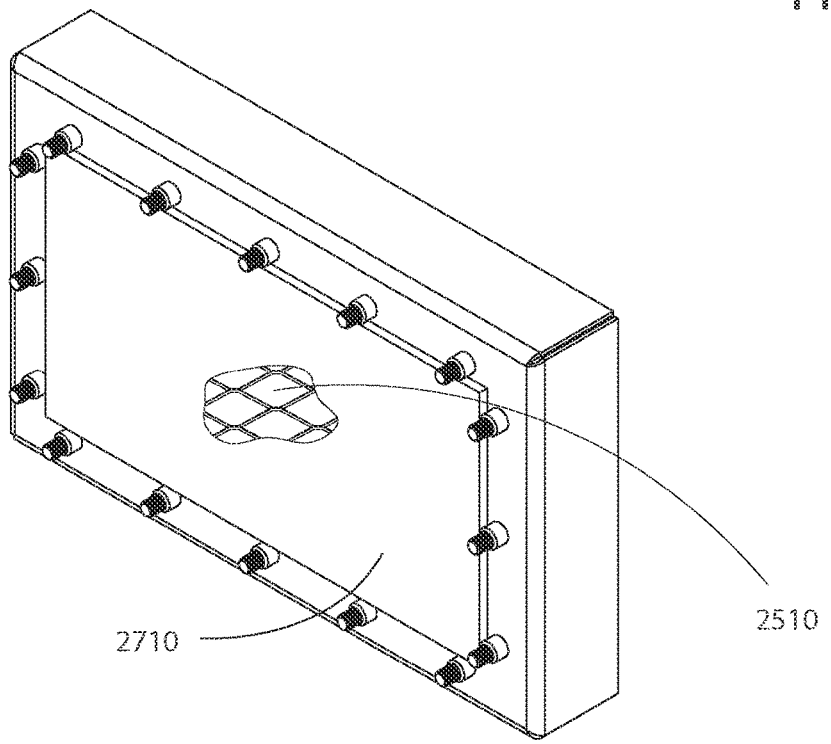
FIG. 29 is an interior view of a vent port for a shipping and storage container in accordance with various embodiments herein.

FIG. 25 is an exterior elevational view of an exit vent port 2520 for a shipping and storage container in accordance with various embodiments herein, showing a partial cut-away, showing a mesh 2510 to prevent entry of pests (such as birds or mice) and a flange 2520 along with fasteners 2530. FIG. 26 is an interior elevational view of a vent port 2510 for a shipping and storage container in accordance with various embodiments herein. FIG. 27 is a side cross sectional view of a vent port showing a cover 2710 for a shipping and storage container in accordance with various embodiments herein. FIG. 28 is an exterior view of an exit vent 410 for a shipping and storage container in accordance with various embodiments herein. FIG. 29 is an interior view of an exit vent 410 for a shipping and storage container in accordance with various embodiments herein.

In an embodiment, the shipping container includes at least two ventilation tubes. In an embodiment, wherein ventilation tube is porous along its length. In an embodiment, the ventilation tubes have a closed end.

In an embodiment, the ventilation tubes rest on removable brackets resting on a floor of the enclosed area.

In an embodiment, the ventilation tubes are positioned within 6 inches of the bottom of the container. In an embodiment, the ventilation tubes are positioned within 12 inches of the bottom of the container. In an embodiment, the ventilation tubes are positioned within 18 inches of the bottom of the container. In an embodiment, the ventilation tubes are positioned within 24 inches of the bottom of the container.

In an embodiment, the ventilation tubes are removable. In an embodiment, the ventilation tubes rest on brackets on the floor of the container without further modification of the floor. In an embodiment, the ventilation tubes connect to a flush port inside the container. In an embodiment, the ports fit within the profile of the container structure to maintain cargo space and use when the tubes are removed.

In an embodiment, wherein input ports on the container can be closed with a seal to return the container to a standard secure shipping container. In an embodiment, the container can be configured to be substantially airtight to retain an inert gas.

In an embodiment, the ventilation tube is attachable to the exterior port with a quick release fastener. In an embodiment, further can include a splitter attachment.

In an embodiment, the socket is flush with the exterior of the container.

In an embodiment, the ventilation tubes extend along the full length of the container.

In an embodiment, the ventilation tubes extend along the 90 percent of the length of the container.

In an embodiment, the ventilation tubes extend along at least 80 percent of the length of the container.

In an embodiment, the ventilation tubes extend along at least 70 percent of the length of the container.

In an embodiment, the ventilation tubes are made of steel.

In an embodiment, the ventilation tubes are made of stainless steel.

In an embodiment, the container includes an exit port.

In an embodiment, the container includes an exit port opposite the location where the ventilation tube enters the exterior of the container.

In an embodiment, the exit port has a cover.

In an embodiment, the exit port has a screen to prevent entry of animals into the container.

In an embodiment, wherein container includes at least one fill port on its top surface.

In an embodiment, the fill port has a cover for sealing.

In an embodiment, further can include a heater in communication with the ventilation tube for pumping heated air into the container.

In an embodiment, further can include a cooler in communication with the ventilation tube for pumping cooled air into the container.

In an embodiment, further can include a dehumidifier in communication with the ventilation tube for pumping dehumidified air into the container.

In an embodiment, further can include a humidifier in communication with the ventilation tube for pumping humidified air into the container.

In an embodiment, further can include dumping doors positioned behind a main door.

In an embodiment, the dumping doors are sectional.

In an embodiment, the ventilation tubes can be combined into a single container for return shipping.

In an embodiment, wherein upon removal of the ventilation tubes the interior of the container complies w/standard container dimensions.

In an embodiment, further can include a removable bulkhead gate.

In an embodiment, the bulkhead gate is removable.

In an embodiment, the intake ports include fans secured permanently into the container walls.

In an embodiment, the bulkhead gate fits tight to back doors of the container but doesn't affect function of the back doors of the container.

In an embodiment, the bulkhead gate fits to the container by spring loaded pins.

In an embodiment, the bottom pins of the gate are releasable to function as a slow-release dump gate.

In an embodiment, wherein top pins of the bulkhead gate are releasable to convert the bulkhead gate to a ramp.

In an embodiment, further can include an external identification code.

In an embodiment, further can include a sensor to monitor the environment inside the shipping and storage container.

In an embodiment, further can include a temperature monitor.

In an embodiment, further can include a humidity monitor.

In an embodiment, further can include a light monitor.

In an embodiment, further can include a shock monitor.

In an embodiment, further can include a food traceability, security or sustainability tracking component.

In an embodiment, a shipping and storage container for the shipment of perishable goods, the shipping container is included having an enclosed area containing a top, a bottom, back wall, side walls, and a front gate, at least to permeable removable ventilation tubes extending into the enclosed area, the ventilation tubes in communication with the exterior of the container, the ventilation tubes secured to flush mounted ports mounted in the back wall of the container, the ports being substantially flush with the interior and exterior of the container.

In an embodiment, wherein ventilation tube is porous along its length.

In an embodiment, the ventilation tubes have a closed end.

In an embodiment, the ventilation tubes rest on removable brackets resting on a floor of the enclosed area.

In an embodiment, the ventilation tubes are positioned within 6 inches of the bottom of the container.

In an embodiment, the ventilation tubes are positioned within 12 inches of the bottom of the container.

In an embodiment, the ventilation tubes are positioned within 18 inches of the bottom of the container.

In an embodiment, the ventilation tubes are positioned within 24 inches of the bottom of the container.

In an embodiment, the ventilation tubes are removable.

In an embodiment, the ventilation tubes rest on brackets on the floor of the container without further modification of the floor.

In an embodiment, the ventilation tubes connect to a flush port inside the container.

In an embodiment, the ports fit within the profile of the container structure to maintain cargo space and use when the tubes are removed.

In an embodiment, wherein input ports on the container can be closed with a seal to return the container to a standard secure shipping container.

In an embodiment, the container can be configured to be substantially airtight to retain an inert gas.

In an embodiment, the ventilation tube is attachable to the exterior port with a quick release fastener.

In an embodiment, further can include a splitter attachment.

In an embodiment, the socket is flush with the exterior of the container.

In an embodiment, the ventilation tubes extend along the full length of the container.

In an embodiment, the ventilation tubes extend along the 90 percent of the length of the container.

In an embodiment, the ventilation tubes extend along at least 80 percent of the length of the container.

In an embodiment, the ventilation tubes extend along at least 70 percent of the length of the container.

In an embodiment, the ventilation tubes are made of steel.

In an embodiment, the ventilation tubes are made of stainless steel.

In an embodiment, the container includes an exit port.

In an embodiment, the container includes an exit port opposite the location where the ventilation tube enters the exterior of the container.

In an embodiment, the exit port has a cover.

In an embodiment, the exit port has a screen to prevent entry of animals into the container.

In an embodiment, wherein container includes at least one fill port on its top surface.

In an embodiment, wherein container includes more than one fill port on its top surface.

In an embodiment, the fill port has a cover for sealing.

In an embodiment, further can include a heater in communication with the ventilation tube for pumping heated air into the container.

In an embodiment, further can include a cooler in communication with the ventilation tube for pumping cooled air into the container.

In an embodiment, further can include a dehumidifier in communication with the ventilation tube for pumping dehumidified air into the container.

In an embodiment, further can include a humidifier in communication with the ventilation tube for pumping humidified air into the container.

In an embodiment, further can include dumping doors positioned behind a main door.

In an embodiment, the dumping doors are sectional.

In an embodiment, the ventilation tubes can be combined into a single container for return shipping.

In an embodiment, wherein upon removal of the ventilation tubes the interior of the container complies w/standard container dimensions.

In an embodiment, further can include a removable bulkhead gate.

In an embodiment, the bulkhead gate is removable.

In an embodiment, the intake ports include fans secured permanently into the container walls.

In an embodiment, the bulkhead gate fits tight to back doors of the container but doesn't affect function of the back doors of the container.

In an embodiment, the bulkhead gate fits to the container by spring loaded pins.

In an embodiment, the bottom pins of the gate are releasable to function as a slow-release dump gate.

In an embodiment, wherein top pins of the bulkhead gate are releasable to convert the bulkhead gate to a ramp.

In an embodiment, further can include an external identification code.

In an embodiment, further can include a sensor to monitor the environment inside the shipping and storage container.

In an embodiment, further can include a temperature monitor.

In an embodiment, further can include a humidity monitor.

In an embodiment, further can include a light monitor.

In an embodiment, further can include a shock monitor.

In an embodiment, further can include a food traceability, security or sustainability tracking component.

It should also be noted that, as used in this specification and the appended claims, the phrase "configured" describes a system, apparatus, or other structure that is constructed or configured to perform a particular task or adopt a particular configuration. The phrase "configured" can be used interchangeably with other similar phrases such as arranged and configured, constructed and arranged, constructed, manufactured and arranged, and the like.

All publications and patent applications in this specification are indicative of the level of ordinary skill in the art to which this invention pertains. All publications and patent applications are herein incorporated by reference to the same extent as if each individual publication or patent application was specifically and individually indicated by reference.

As used herein, the recitation of numerical ranges by endpoints shall include all numbers subsumed within that range (e.g., 2 to 8 includes 2.1, 2.8, 5.3, 7, etc.).

The headings used herein are provided for consistency with suggestions under 37 CFR 1.77 or otherwise to provide organizational cues. These headings shall not be viewed to limit or characterize the invention(s) set out in any claims that may issue from this disclosure. As an example, although the headings refer to a "Field," such claims should not be limited by the language chosen under this heading to describe the so-called technical field. Further, a description of a technology in the "Background" is not an admission that technology is prior art to any invention(s) in this disclosure. Neither is the "Summary" to be considered as a characterization of the invention(s) set forth in issued claims.

The embodiments described herein are not intended to be exhaustive or to limit the invention to the precise forms disclosed in the following detailed description. Rather, the embodiments are chosen and described so that others skilled in the art can appreciate and understand the principles and practices. As such, aspects have been described with reference to various specific and preferred embodiments and techniques. However, it should be understood that many variations and modifications may be made while remaining within the spirit and scope herein.

The invention claimed is:

1. A shipping and storage container for the shipment of perishable goods, the shipping container comprising:

an enclosed area;

at least one removable ventilation tube extending into the enclosed area, the ventilation tube in communication with an exterior of the container;

wherein the shipping container includes at least two ventilation tubes;

wherein ventilation tube is porous along its length;

wherein the ventilation tubes are positioned within 12 inches of the bottom of the container;

wherein the ventilation tubes connect to a flush port inside the container; and wherein the flush ports fit within a profile of the container structure to maintain cargo space and use when the tubes are removed;

wherein the container comprises a bulkhead gate and the bulkhead gate fits tight to back doors of the container but doesn't affect function of the back doors of the container.

2. The shipping and storage container of claim 1, wherein the ventilation tubes rest on removable brackets resting on a floor of the enclosed area.

3. The shipping and storage container of claim 1, wherein the ventilation tubes are removable.

4. The shipping and storage container of claim 1, wherein the ventilation tubes connect to a flush port inside the container.

5. The shipping and storage container of claim 1, wherein the ventilation tubes extend along a full length of the container.

6. The shipping and storage container of claim 1, wherein the container includes an exit port opposite the location where the ventilation tube enters an exterior of the container.

7. The shipping and storage container of claim 1, wherein container includes at least one fill port on its top surface.

8. The shipping and storage container of claim 1, further comprising dumping doors positioned behind a main door.

9. The shipping and storage container of claim 1, further comprising a gate comprising bottom pins, wherein the bottom pins of the gate are releasable to function as a slow-release dump gate.

10. A shipping and storage container for the shipment of perishable goods, the shipping container comprising:

an enclosed area containing a top, a bottom, back wall, side walls, and a front gate;

at least two permeable removable ventilation tubes extending into the enclosed area, the ventilation tubes in communication with the exterior of the container;

the ventilation tubes secured to flush mounted ports mounted in the back wall of the container, the ports being substantially flush with an interior and an exterior of the container;

further comprising a bulkhead, wherein the bulkhead gate fits tight to back doors of the container but doesn't affect function of the back doors of the container;

wherein ventilation tube is porous along its length;

wherein the ventilation tubes have a closed end;

wherein the ventilation tubes rest on removable brackets resting on a floor of the enclosed area;

wherein the shipping and storage container comprises a socket, and the socket is flush with the exterior of the container; and wherein the container includes an exit port opposite a location where the ventilation tube enters the exterior of the container.

11. The shipping and storage container of claim 10, wherein the ventilation tubes are positioned within 12 inches of the bottom of the container.

12. The shipping and storage container of claim 10, wherein the ventilation tubes connect to a flush port inside the container.

13. The shipping and storage container of claim 10, wherein the ventilation tubes extend along a full length of the container.

14. The shipping and storage container of claim 10, wherein container includes at least one fill port on its top surface.

15. The shipping and storage container of claim 10, wherein container includes more than one fill port on its top surface.

16. The shipping and storage container of claim 10, further comprising dumping doors positioned behind a main door.

17. The shipping and storage container of claim 10, wherein the bottom pins of the gate are releasable to function as a slow-release dump gate.

18. The shipping and storage container of claim 10, further comprising a bulkhead gate comprising top pins, wherein top pins of the bulkhead gate are releasable to convert the bulkhead gate to a ramp.

* * * * *